US011552419B2

(12) United States Patent
Obata et al.

(10) Patent No.: US 11,552,419 B2
(45) Date of Patent: Jan. 10, 2023

(54) FLOATING CONNECTOR

(71) Applicant: JAPAN AVIATION ELECTRONICS INDUSTRY, LIMITED, Tokyo (JP)

(72) Inventors: Yusuke Obata, Tokyo (JP); Takashi Tokunaga, Tokyo (JP); Kiichi Hori, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/220,045

(22) Filed: Apr. 1, 2021

(65) Prior Publication Data

US 2021/0376510 A1 Dec. 2, 2021

(30) Foreign Application Priority Data

May 28, 2020 (JP) ..... JP2020-093203

(51) Int. Cl.
*H01R 12/91* (2011.01)
*H01R 12/71* (2011.01)
*H01R 13/24* (2006.01)

(52) U.S. Cl.
CPC ..... *H01R 12/91* (2013.01); *H01R 12/71* (2013.01); *H01R 13/24* (2013.01)

(58) Field of Classification Search
CPC ..... H01R 23/725; H01R 9/096; H01R 12/91; H01R 12/71; H01R 13/24
(Continued)

(56) References Cited

U.S. PATENT DOCUMENTS 5,915,976 A * 6/1999 McHugh ..... H01R 13/6582 439/74
6,045,380 A * 4/2000 Hashimoto ..... H01R 13/6315 439/248
(Continued)

FOREIGN PATENT DOCUMENTS

JP 2012164525 A 8/2012
JP 5825477 B2 10/2015
(Continued)

OTHER PUBLICATIONS

Extended European Search Report (EESR) dated Dec. 9, 2021, issued in counterpart European Application No. 21165477.7.
(Continued)

*Primary Examiner* — Gary F Paumen
(74) *Attorney, Agent, or Firm* — Holtz, Holtz & Volek PC

(57) ABSTRACT

A floating connector comprises a movable housing, a plurality of contacts and at least one ground member. Each of the contacts has a fixed portion, a first held portion, a coupling portion, an extending portion and a contact portion. The coupling portion is resiliently deformable. The movable housing is movable within a predetermined range in a plane perpendicular to an up-down direction by the resilient deformation. The contacts include a plurality of ground contacts and a signal contact. The ground member has a plurality of ground contact portions, a plurality of supporting portions, a ground coupling portion and a second held portion. The ground contact portions correspond to the ground contacts, respectively. Each of the ground contact portions is brought into contact with the corresponding ground contact even when the movable housing is moved within the predetermined range. The ground coupling portion couples the supporting portions with each other.

7 Claims, 20 Drawing Sheets

(58) Field of Classification Search
USPC ..... 439/74, 247, 248
See application file for complete search history.

(56) References Cited

U.S. PATENT DOCUMENTS

| | | | | |
|---|---|---|---|---|
| 6,159,021 | A * | 12/2000 | Kusuhara | H01R 12/716 439/74 |
| 6,250,935 | B1 * | 6/2001 | Mochizuki | H01R 13/658 439/74 |
| 6,390,828 | B1 * | 5/2002 | Yamaguchi | H01R 13/631 439/247 |
| 7,207,842 | B1 * | 4/2007 | Kenjo | H01R 12/79 439/74 |
| 7,585,185 | B2 * | 9/2009 | Obikane | H01R 12/716 439/74 |
| 8,257,095 | B2 * | 9/2012 | Akai | H01R 13/6315 439/74 |
| 9,692,183 | B2 | 6/2017 | Phillips et al. | |
| 10,128,614 | B2 | 11/2018 | Suzuki et al. | |
| 10,680,386 | B2 | 6/2020 | Kakino et al. | |
| 10,971,839 | B1 * | 4/2021 | Kuo | H01R 12/724 |
| 2005/0101163 | A1 * | 5/2005 | Obikane | H01R 13/6471 439/74 |
| 2009/0061655 | A1 * | 3/2009 | Miyazaki | H01R 12/57 439/74 |
| 2014/0193995 | A1 * | 7/2014 | Barthelmes | H01R 13/629 439/374 |
| 2016/0172803 | A1 | 6/2016 | Tamai | |
| 2020/0052424 | A1 | 2/2020 | Aoki et al. | |
| 2020/0313327 | A1 | 10/2020 | Morita et al. | |

FOREIGN PATENT DOCUMENTS

| | | | |
|---|---|---|---|
| JP | 2016139602 | A | 8/2016 |
| JP | 2017157304 | A | 9/2017 |
| JP | 2018133309 | A | 8/2018 |
| JP | 2019071191 | A | 5/2019 |
| JP | 2019079727 | A | 5/2019 |
| JP | 2019079787 | A | 5/2019 |
| JP | 2019114565 | A | 7/2019 |
| JP | 2019114566 | A | 7/2019 |
| JP | 2019125583 | A | 7/2019 |
| JP | 2019125584 | A | 7/2019 |
| JP | 6598912 | B2 | 10/2019 |
| JP | 2019169370 | A | 10/2019 |
| TW | 201818618 | A | 5/2018 |
| TW | M573903 | U | 2/2019 |

OTHER PUBLICATIONS

Taiwanese Office Action (and English language translation thereof) dated Jan. 28, 2022, issued in counterpart Taiwanese Application No. 110110186.

* cited by examiner

FLOATING CONNECTOR

CROSS REFERENCE TO RELATED APPLICATIONS

This application is based on and claims priority under 35 U.S.C. § 119 to Japanese Patent Application No. JP2020-093203 filed May 28, 2020, the contents of which are incorporated herein in their entirety by reference.

BACKGROUND OF THE INVENTION

This invention relates to a floating connector comprising a plurality of contacts which include a plurality of ground contacts and a signal contact.

As shown in FIGS. 36 and 37, JPA2016-139602 (Patent Document 1) discloses a connector 900 comprising a plurality of contacts 910 and an earthing bus 930. The contacts 910 include a plurality of earthing contacts 912, or ground contacts 912, and a plurality of signal contacts 916. The ground contacts 912 are electrically integrated with each other by the earthing bus 930.

If the earthing bus 930 of Patent Document 1 is applied to a floating connector, the manufacturing of the floating connector requires the following steps and order: the floating connector is required to be manufactured in the following steps and order: independently preparing a set of ground contacts, which are integrated with each other by an earthing bus, and a signal contact; and arranging the ground contacts and the signal contact at locations, respectively, in the floating connector. This makes it difficult to appropriately arrange the contacts in the floating connector.

In addition, the floating connector, to which the earthing bus 930 of Patent Document 1 is applied, is configured so that, during floating action of a housing of the floating connector, a stress applied to the signal contact is unequal to a stress applied to the ground contact. The unequal stress causes a difference between degree of deformation of the signal contact and degree of displacement of the ground contact so that the signal contact and the ground contact might be short-circuited with each other.

Thus, the earthing bus 930 of Patent Document 1 is not suitable for floating connectors.

SUMMARY OF THE INVENTION

It is therefore an object of the present invention to provide a floating connector having a structure which is suitable for providing floating action and which enables a plurality of ground contacts to be electrically integrated with each other.

One aspect of the present invention provides a floating connector used in a state where the floating connector is mounted on a circuit board. The floating connector is mateable with and removable from a mating connector along an up-down direction. The mating connector has a mating contact portion. The floating connector comprises a movable housing, a plurality of contacts and at least one ground member. The movable housing has a first holding portion and a second holding portion. Each of the contacts has a fixed portion, a first held portion, a coupling portion, an extending portion and a contact portion. The fixed portion is fixed to the circuit board when the floating connector is mounted on the circuit board. The first held portion is held by the first holding portion. The coupling portion couples the fixed portion and the first held portion with each other. The coupling portion is resiliently deformable. The movable housing is movable within a predetermined range in a plane perpendicular to the up-down direction by the resilient deformation. The extending portion extends upward in the up-down direction from the first held portion. The contact portion is brought into contact with the mating contact portion when the floating connector is mated with the mating connector. The contact portion is supported by the extending portion. The contacts include a plurality of ground contacts and a signal contact. The ground member has a plurality of ground contact portions, a plurality of supporting portions, a ground coupling portion and a second held portion. The ground contact portions correspond to the ground contacts, respectively. Each of the ground contact portions is brought into contact with the corresponding ground contact even when the movable housing is moved within the predetermined range. The supporting portions support the ground contact portions, respectively. The ground coupling portion couples the supporting portions with each other. The second held portion is held by the second holding portion.

Another aspect of the present invention provides a floating connector used in a state where the floating connector is mounted on a circuit board. The floating connector is mateable with and removable from a mating connector along an up-down direction. The mating connector has a mating contact portion. The floating connector comprises a movable housing, a fixed housing, a plurality of contacts and at least one ground member. The movable housing has a first holding portion. The fixed housing has a second holding portion and a third holding portion. Each of the contacts has a fixed portion, a first held portion, a third held portion, a deformable portion, an extending portion and a contact portion. The fixed portion is fixed to the circuit board when the floating connector is mounted on the circuit board. The first held portion is held by the first holding portion. The third held portion is held by the third holding portion. The deformable portion couples the first held portion and the third held portion with each other. The deformable portion is resiliently deformable. The movable housing is movable within a predetermined range in a plane perpendicular to the up-down direction by the resilient deformation. The extending portion extends upward in the up-down direction from the first held portion. The contact portion is brought into contact with the mating contact portion when the floating connector is mated with the mating connector. The contact portion is supported by the extending portion. The contacts include a plurality of ground contacts and a signal contact. The ground member has a plurality of ground contact portions, a plurality of supporting portions, a ground coupling portion and a second held portion. The ground contact portions correspond to the ground contacts, respectively. Each of the ground contact portions is brought into contact with the corresponding ground contact even when the movable housing is moved within the predetermined range. The supporting portions support the ground contact portions, respectively. The ground coupling portion couples the supporting portions with each other. The second held portion is held by the second holding portion.

The floating connector of the present invention comprises the movable housing, the plurality of contacts and the at least one ground member. Additionally, the contacts include the plurality of ground contacts and the signal contact. Furthermore, each of the ground contact portions of the ground member is brought into contact with the corresponding ground contact even when the movable housing is moved within the predetermined range. Specifically, the floating connector of the present invention comprises the ground member which is distinct and separated from any of the contacts, and the ground member is common to the ground contacts. This easily enables the contacts to be appropriately arranged in the floating connector of the present invention. In addition, during floating action of the movable housing, this can match degree of deformation of the signal contact with degree of displacement of the ground contact. In other words, the floating connector of the present invention has a structure which is suitable for providing floating action and which enables the plurality of ground contacts to be electrically integrated with each other.

An appreciation of the objectives of the present invention and a more complete understanding of its structure may be had by studying the following description of the preferred embodiment and by referring to the accompanying drawings.

Figure 1:
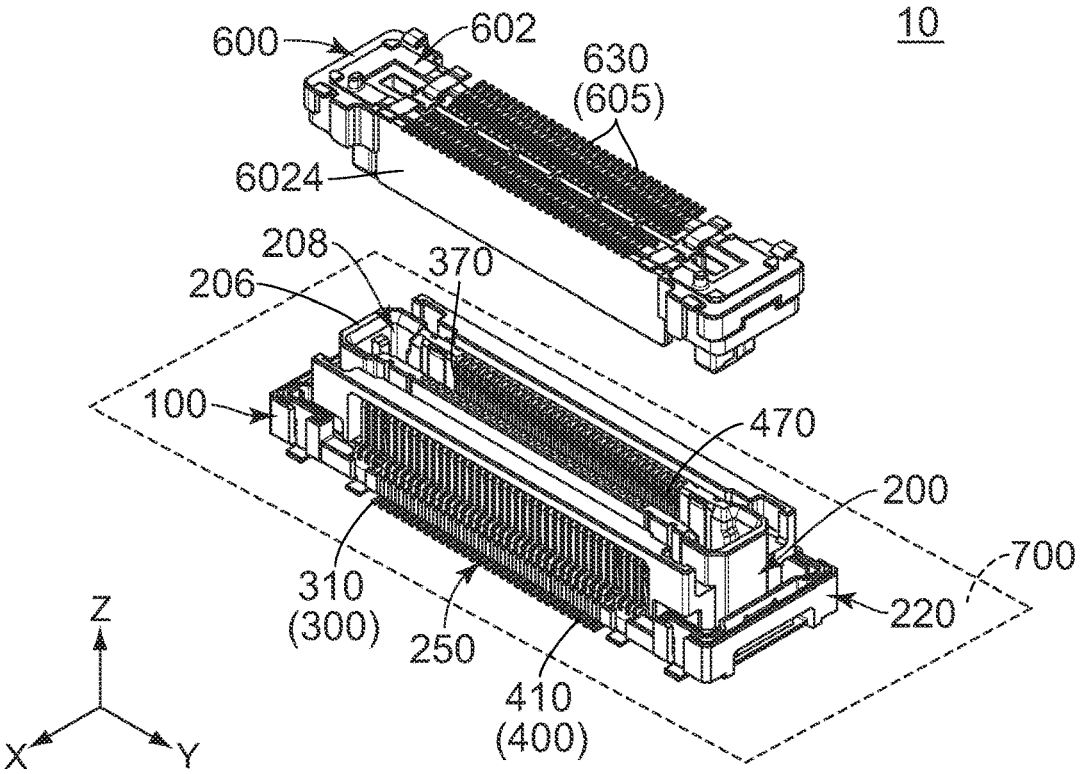
FIG. 1 is a perspective view showing a connector assembly according to a first embodiment of the present invention. In the figure, a floating connector and a mating connector are in an unmated state where the floating connector and the mating connector are unmated with each other, and a circuit board is illustrated by dotted line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIG. 1, a connector assembly 10 according to a first embodiment of the present invention comprises a mating connector 600 and a floating connector 100.

Figure 4:
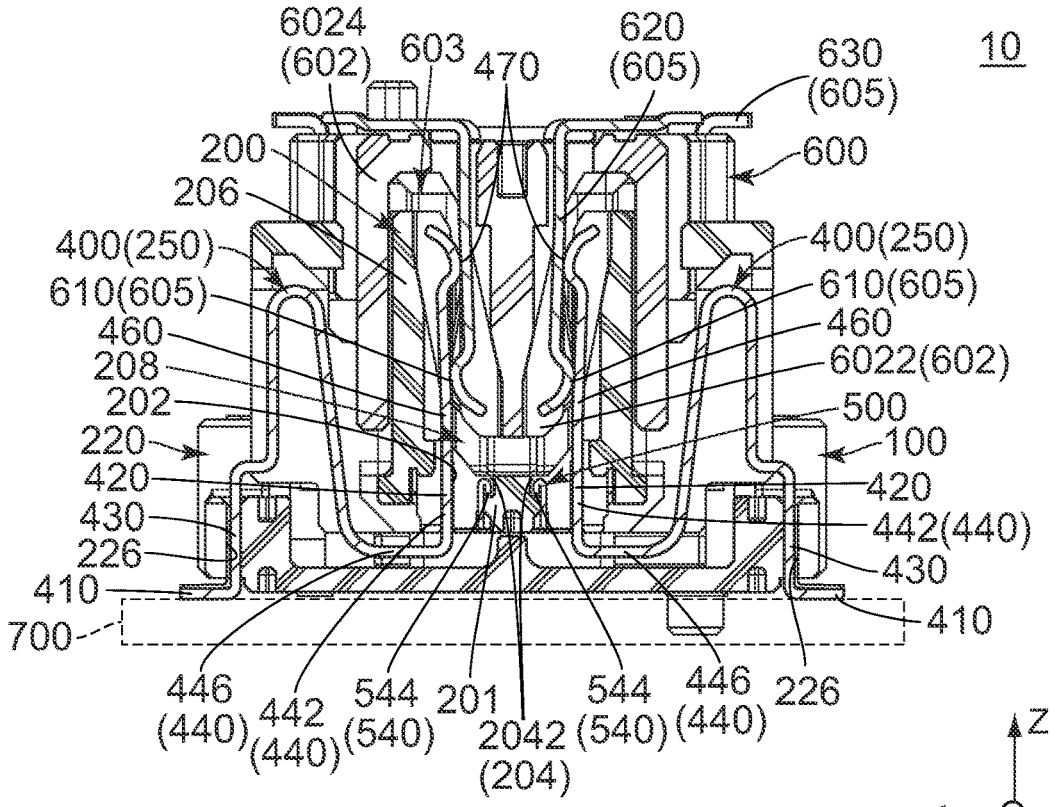
FIG. 4 is a cross-sectional view showing the connector assembly of FIG. 3, taken along line A-A. In the figure, the circuit board is illustrated by dotted line.
Figure 6:
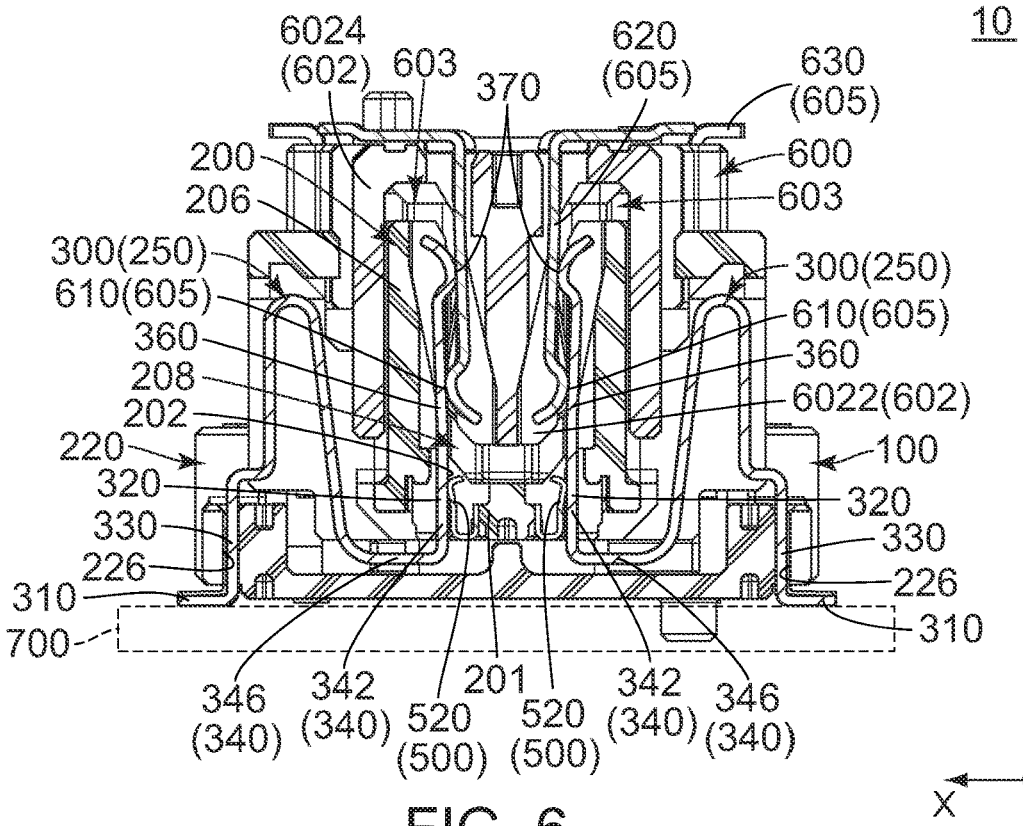
FIG. 6 is a cross-sectional view showing the connector assembly of FIG. 3, taken along line B-B. In the figure, the circuit board is illustrated by dotted line.

As shown in FIGS. 4 and 6, the mating connector 600 of the present embodiment has a mating housing 602 and a plurality of mating contacts 605.

Referring to FIGS. 4 and 6, the mating housing 602 of the present embodiment is made of insulator. The mating housing 602 holds the mating contacts 605. The mating housing 602 has a protruding portion 6022, a mating surrounding portion 6024 and a movable housing receiving portion 603.

As shown in FIGS. 4 and 6, the protruding portion 6022 of the present embodiment protrudes downward in an up-down direction. The protruding portion 6022 is surrounded by the mating surrounding portion 6024 in a plane perpendicular to the up-down direction. In the present embodiment, the up-down direction is a Z-direction. Specifically, it is assumed that upward is a positive Z-direction while downward is a negative Z-direction. Additionally, in the present embodiment, the plane perpendicular to the up-down direction is an XY-plane.

As shown in FIGS. 4 and 6, the mating surrounding portion 6024 of the present embodiment surrounds the protruding portion 6022 in the plane perpendicular to the up-down direction. The mating surrounding portion 6024 surrounds the movable housing receiving portion 603 in the plane perpendicular to the up-down direction.

As shown in FIGS. 4 and 6, the movable housing receiving portion 603 of the present embodiment opens downward in the up-down direction. The movable housing receiving portion 603 is a space extending in the up-down direction.

Figure 5:
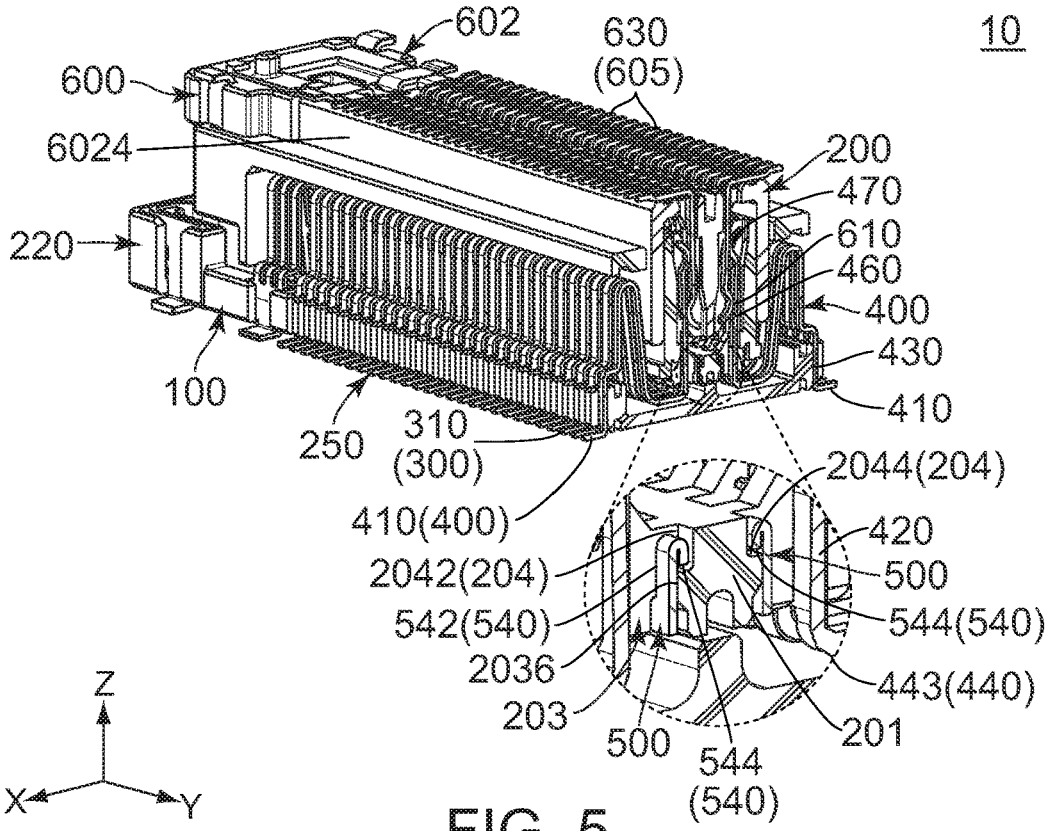
FIG. 5 is a perspective, cross-sectional view showing the connector assembly of FIG. 4. In the figure, parts of a movable housing, signal contacts and ground members are illustrated enlarged.
Figure 7:
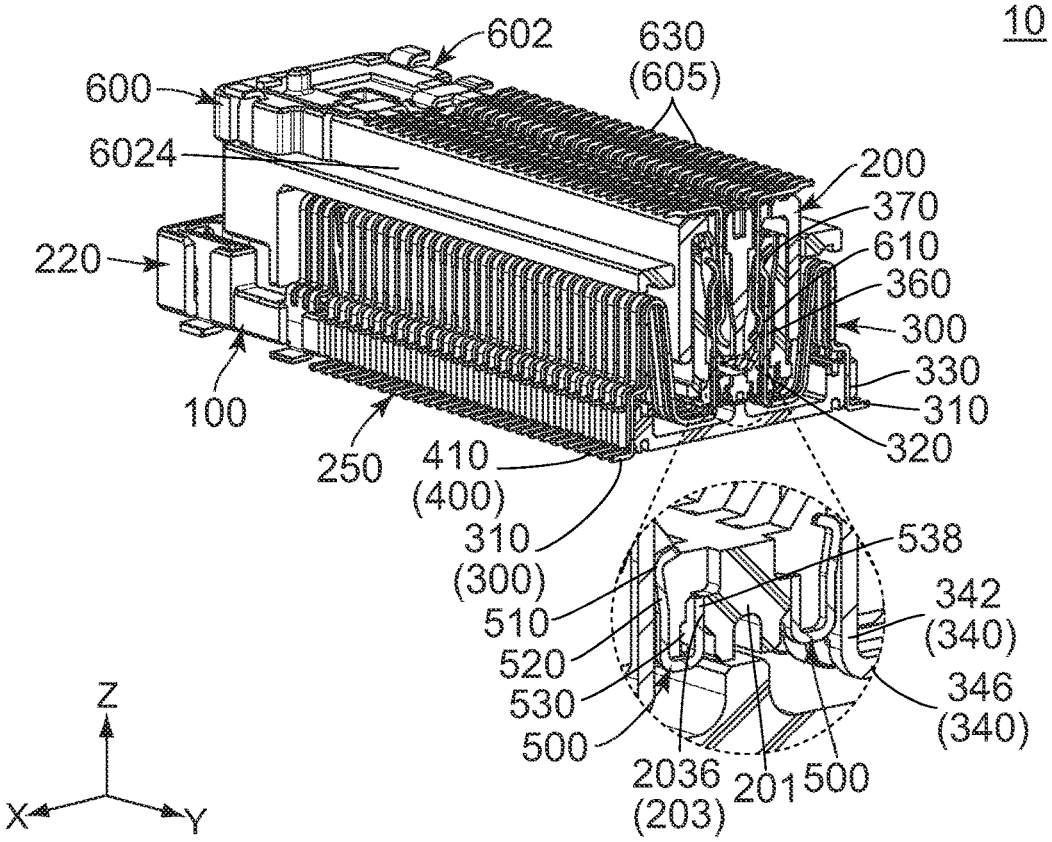
FIG. 7 is a perspective, cross-sectional view showing the connector assembly of FIG. 6. In the figure, parts of the movable housing, ground contacts and the ground members are illustrated enlarged.
Figure 8:
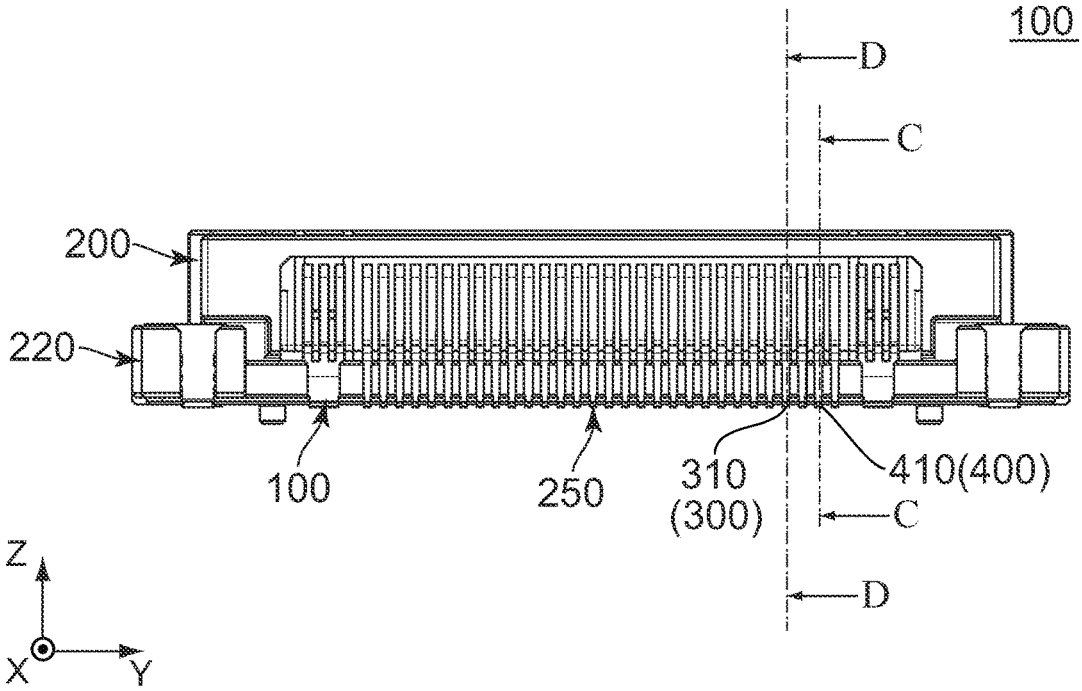
FIG. 8 is a front view showing the floating connector which is included in the connector assembly of FIG. 3.

As shown in FIGS. 5 and 7, the mating contacts 605 of the present embodiment are arranged in two rows which are arranged in a width direction perpendicular to the up-down direction. In the present embodiment, the width direction is an X-direction. Specifically, it is assumed that forward is a positive X-direction while rearward is a negative X-direction. The mating contacts 605 of each of the rows are arranged in a pitch direction perpendicular to both the up-down direction and the width direction. In the present embodiment, the pitch direction is a Y-direction. Referring to FIGS. 4 and 6, each of the mating contacts 605 is made of metal and is a spring contact. In the movable housing receiving portion 603, a part of the mating contact 605 is exposed from an outer surface of the protruding portion 6022 in the width direction. Each of the mating contacts 605 has a mating contact portion 610, a mating extending portion 620 and a mating fixed portion 630. In other words, the mating connector 600 has the mating contact portions 610.

As shown in FIGS. 4 and 6, the mating contact portion 610 of the present embodiment faces outward in the width direction. In the movable housing receiving portion 603, the mating contact portion 610 is exposed from the outer surface of the protruding portion 6022 in the width direction.

As shown in FIGS. 4 and 6, the mating extending portion 620 of the present embodiment extends in the up-down direction. The mating extending portion 620 supports the mating contact portion 610.

As shown in FIGS. 4 and 6, the mating fixed portion 630 of the present embodiment extends outward in the width direction from the mating extending portion 620. The mating fixed portion 630 defines an upper end of the mating contact 605 in the up-down direction. The mating fixed portion 630 defines an outer end of the mating contact 605 in the width direction.

Figure 2:
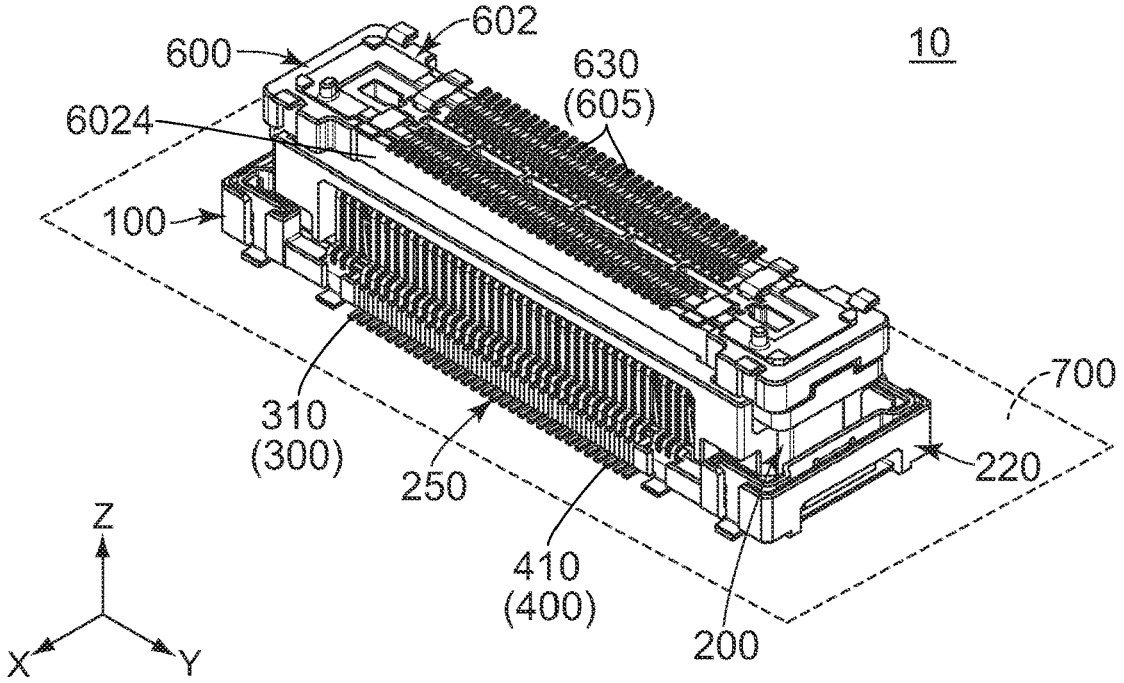
FIG. 2 is another perspective view showing the connector assembly of FIG. 1. In the figure, the floating connector and the mating connector are in a mated state where the floating connector and the mating connector are mated with each other, and the circuit board is illustrated by dotted line.
Figure 3:
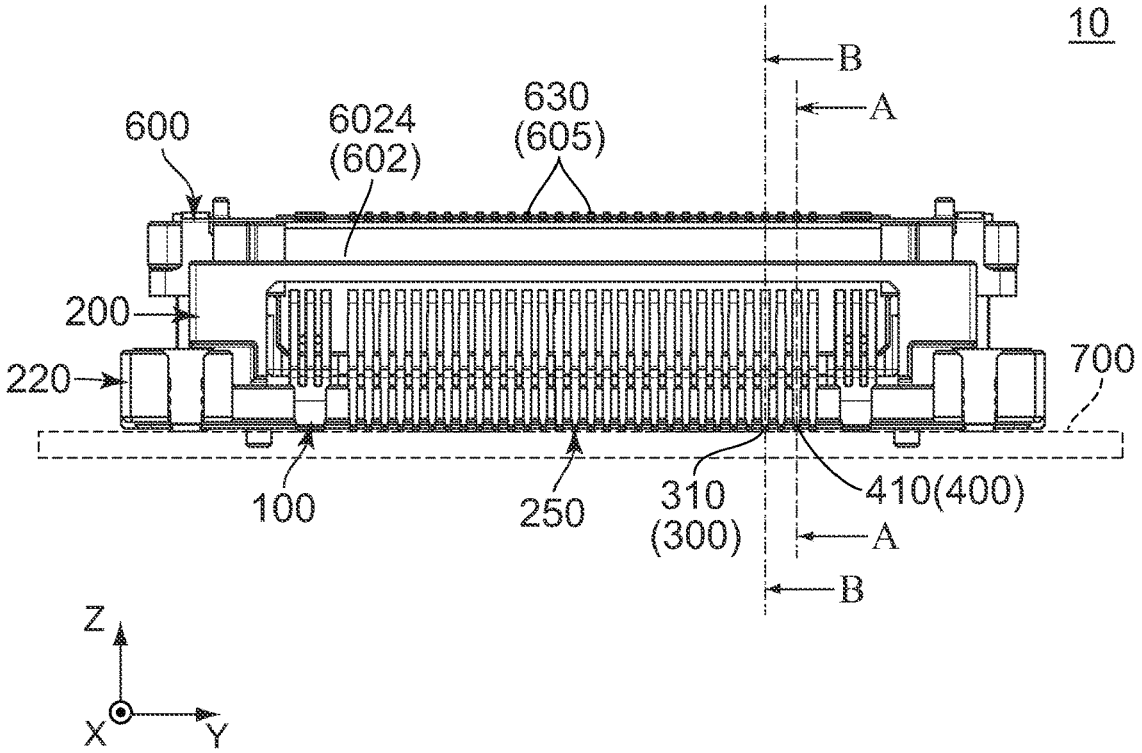
FIG. 3 is a front view showing the connector assembly of FIG. 2. In the figure, the circuit board is illustrated by dotted line.

As shown in FIGS. 1 and 2, the floating connector 100 of the present embodiment is used in a state where the floating connector 100 is mounted on a circuit board 700. The floating connector 100 of the present embodiment is mateable with and removable from the mating connector 600 along the up-down direction.

Figure 11:
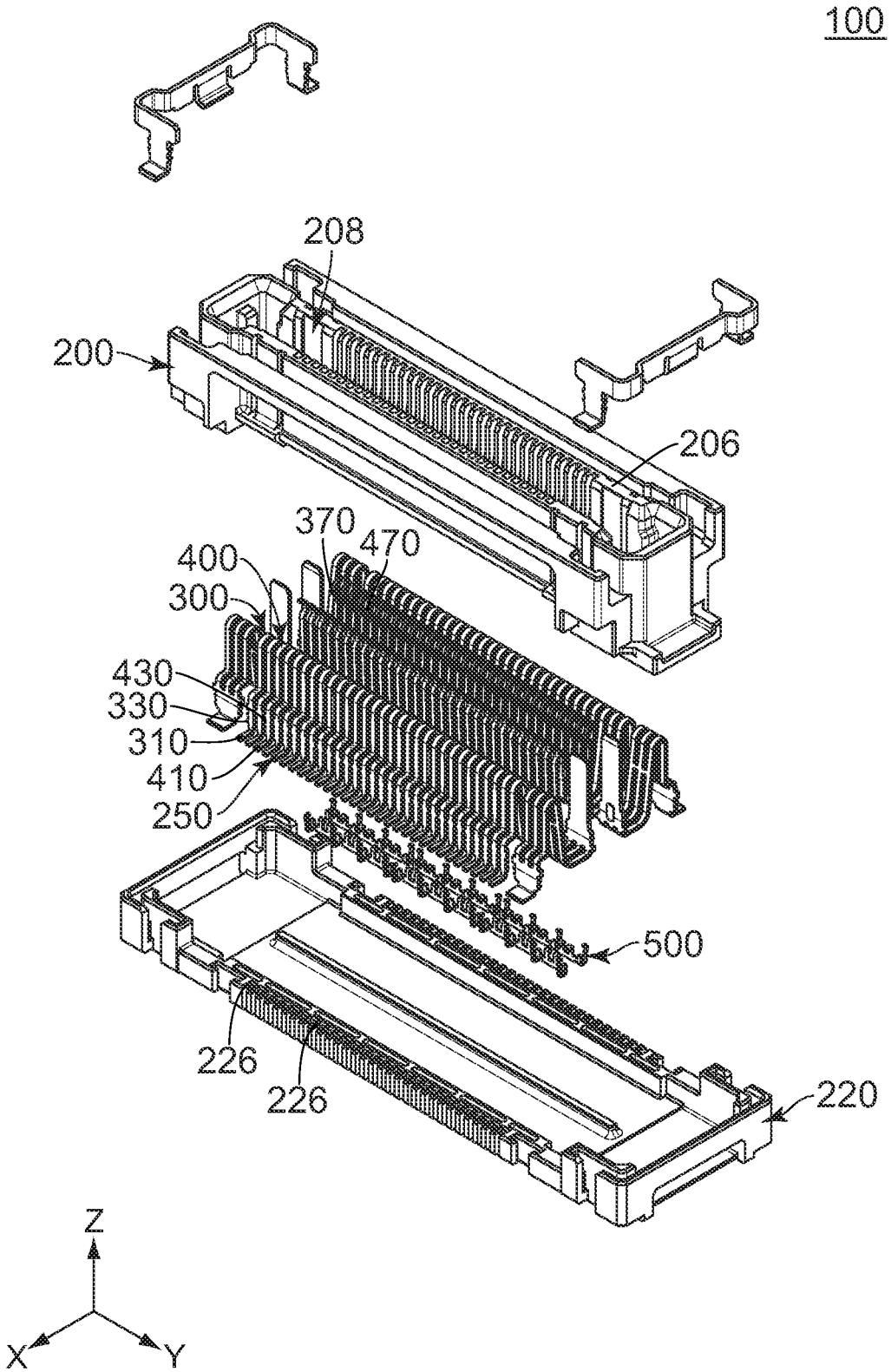
FIG. 11 is an exploded, perspective view showing the floating connector of FIG. 8.

As shown in FIG. 11, the floating connector 100 of the present embodiment comprises a movable housing 200, a fixed housing 220, a plurality of contacts 250, and a plurality of ground members 500. However, the present invention is not limited thereto. The floating connector 100 should comprise the movable housing 200, the plurality of contacts 250 and at least one ground member 500. In other words, the floating connector 100 may comprise no fixed housing 220.

Figure 9:
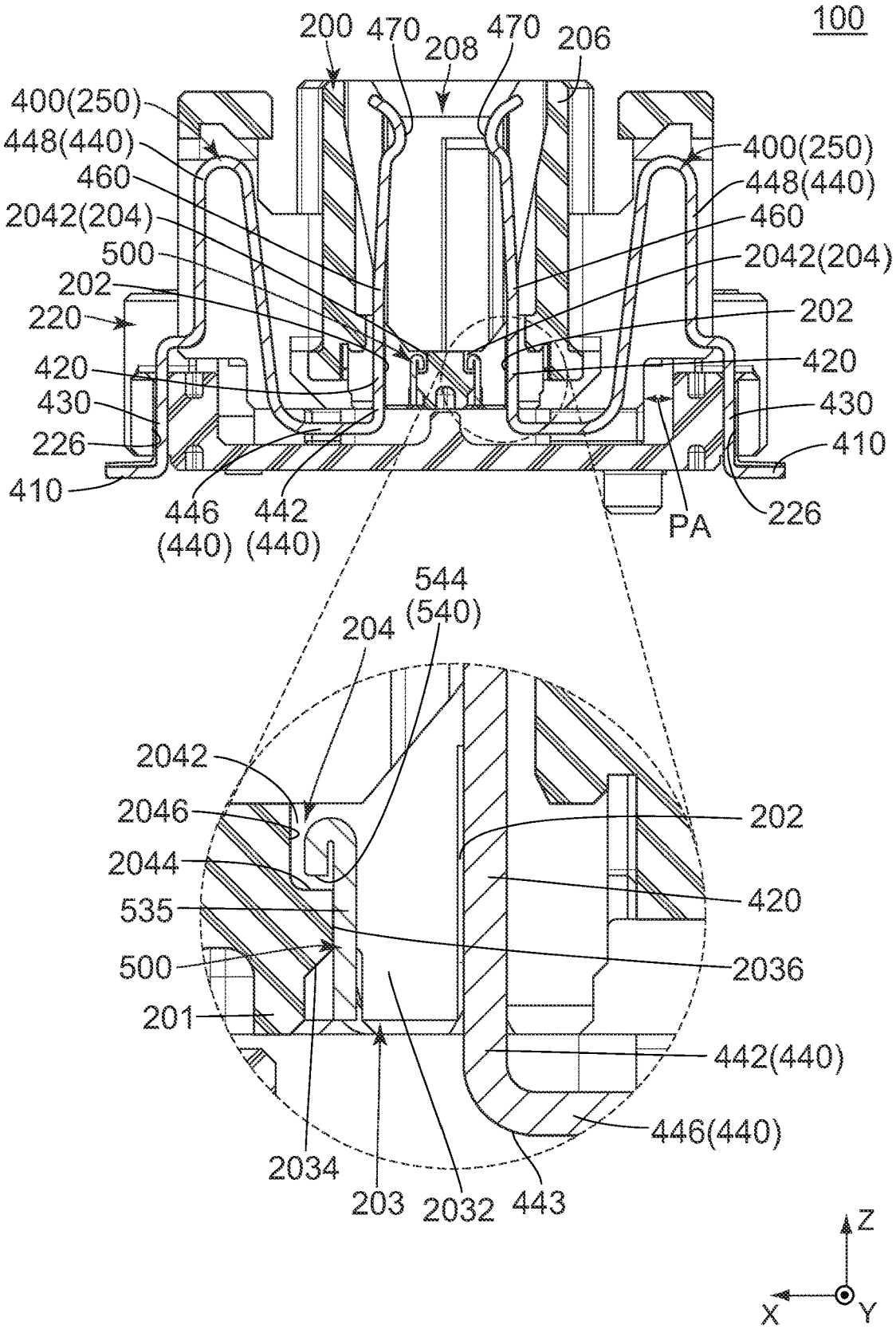
FIG. 9 is a cross-sectional view showing the floating connector of FIG. 8, taken along line C-C. In the figure, parts of the movable housing, the signal contact and the ground member are illustrated enlarged.
Figure 10:
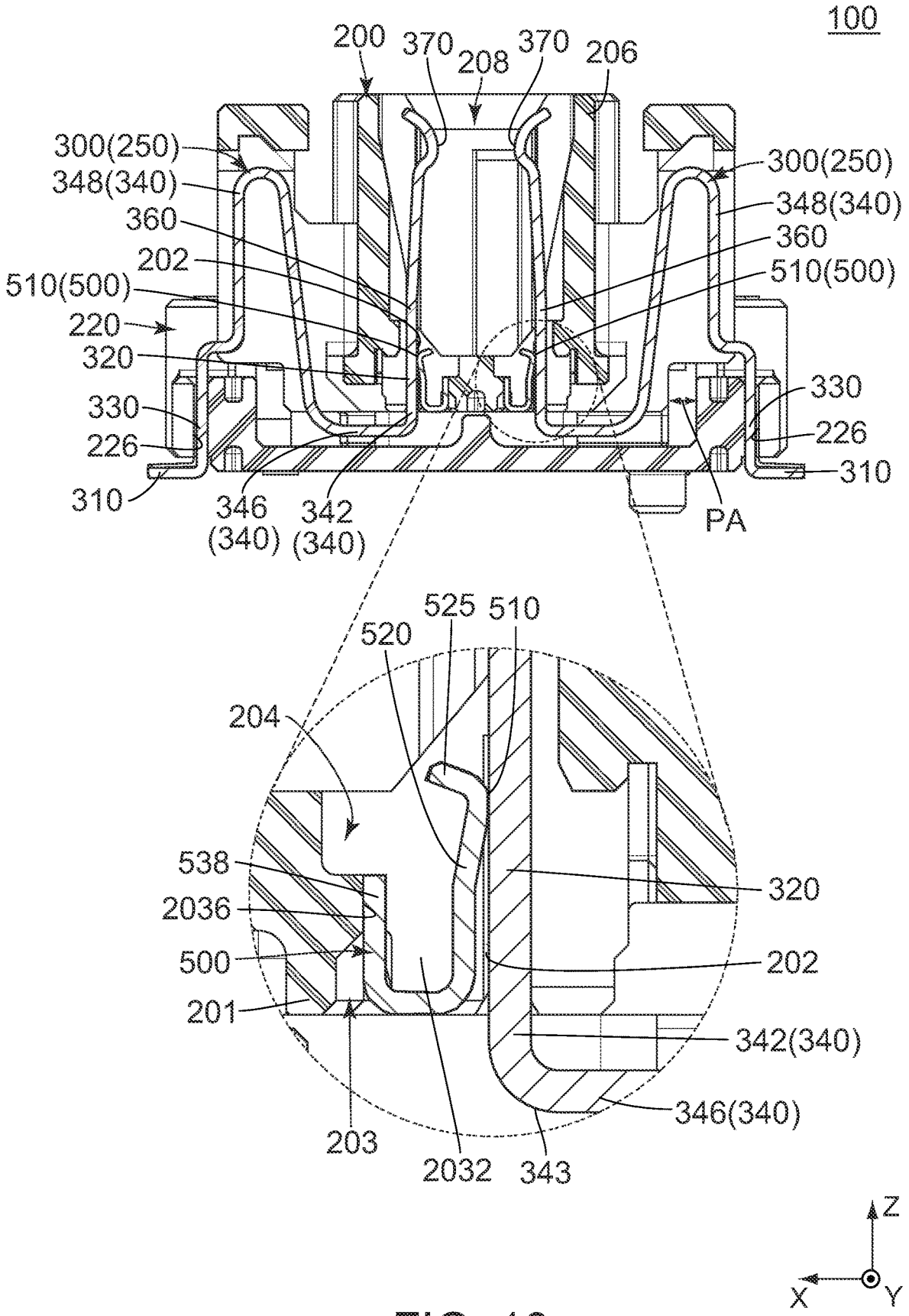
FIG. 10 is a cross-sectional view showing the floating connector of FIG. 8, taken along line D-D. In the figure, parts of the movable housing, the ground contact and the ground member are illustrated enlarged.

Referring to FIG. 11, the movable housing 200 of the present embodiment is made of insulator. As shown in FIGS. 9 and 10, the movable housing 200 has a surrounding portion 206, an accommodating portion 208 and a bottom portion 201.

As shown in FIGS. 9 to 11, the surrounding portion 206 of the present embodiment has a substantially rectangular tube shape extending in the up-down direction.

As shown in FIGS. 9 to 11, the accommodating portion 208 of the present embodiment opens upward in the up-down direction. The accommodating portion 208 is surrounded by the surrounding portion 206 in the plane perpendicular to the up-down direction. As shown in FIGS. 4 and 6, the accommodating portion 208 accommodates the protruding portion 6022 of the mating connector 600 when the floating connector 100 and the mating connector 600 are mated with each other.

As shown in FIGS. 9 and 10, the bottom portion 201 of the present embodiment is positioned below the accommodating portion 208 in the up-down direction. The bottom portion 201 defines a lower end of the movable housing 200 in the up-down direction. The bottom portion 201 has a plurality of first holding portions 202 and a plurality of inserting holes 203.

As understood from FIGS. 9 and 10, each of the first holding portions 202 of the present embodiment consists of two ditches each extending in the up-down direction. The first holding portions 202 correspond to the contacts 250, respectively. Each of the ditches of the first holding portion 202 has an inner wall which faces inward in the pitch direction.

As shown in FIGS. 9 and 10, each of the inserting holes 203 of the present embodiment is an aperture piercing the bottom portion 201 in the up-down direction. The inserting holes 203 have shapes same as each other. Each of the inserting holes 203 is positioned below the accommodating portion 208 in the up-down direction. Each of the inserting holes 203 has two wall surfaces 2032, an oblique surface 2034, a flat surface 2036 and a second holding portion 204. In other words, the movable housing 200 has the first holding portions 202 and the second holding portions 204.

Referring to FIGS. 9 and 10, the wall surfaces 2032 of the present embodiment are positioned at opposite sides, respectively, of the inserting hole 203 in the pitch direction. Each of the wall surfaces 2032 is a plane perpendicular to the pitch direction.

As shown in FIG. 9, the oblique surface 2034 of the present embodiment is a plane intersecting with both the up-down direction and the width direction. More specifically, the oblique surface 2034 extends upward in the up-down direction and outward in the width direction.

Referring to FIG. 9, the flat surface 2036 of the present embodiment is perpendicular to the width direction. The flat surface 2036 is positioned between the oblique surface 2034 and the second holding portion 204 in the up-down direction. More specifically, in the up-down direction, the flat surface 2036 is positioned above the oblique surface 2034 and below the second holding portion 204. The flat surface 2036 couples the two wall surfaces 2032 with each other in the pitch direction.

Referring to FIG. 9, the second holding portion 204 of the present embodiment is recessed inward in the width direction. The second holding portion 204 is positioned between the two wall surfaces 2032 in the pitch direction. The second holding portion 204 has two side walls 2042, a bottom surface 2044 and an inner surface 2046.

Referring to FIGS. 5 and 9, the side walls 2042 of the present embodiment are positioned at opposite sides, respectively, of the second holding portion 204 in the pitch direction. Each of the side walls 2042 is a plane perpendicular to the pitch direction. The side walls 2042 correspond to the wall surfaces 2032, respectively. Each of the side walls 2042 is flush with the wall surface 2032 corresponding thereto. In other words, each of the side walls 2042 is positioned, in the pitch direction, at the same position as the wall surface 2032 corresponding thereto.

As shown in FIGS. 5 and 9, the bottom surface 2044 of the present embodiment is a surface facing upward in the up-down direction. The bottom surface 2044 defines a lower end of the second holding portion 204 in the up-down direction.

As shown in FIG. 9, the inner surface 2046 of the present embodiment is a surface facing outward in the width direction. The inner surface 2046 defines an inner end of the second holding portion 204 in the width direction.

Referring to FIG. 11, the fixed housing 220 of the present embodiment is made of insulator. The fixed housing 220 has a substantially plate-like shape perpendicular to the up-down direction. The fixed housing 220 has a plurality of third holding portions 226.

Referring to FIGS. 9 and 10, the third holding portions 226 of the present embodiment correspond to the contacts 250, respectively. Each of the third holding portions 226 is a hole piercing the fixed housing 220 in the up-down direction. Each of the third holding portions 226 is positioned in the vicinity of an outer end of the fixed housing 220 in the width direction. Each of the third holding portions 226 has two inner walls each facing inward in the pitch direction.

Figure 12:
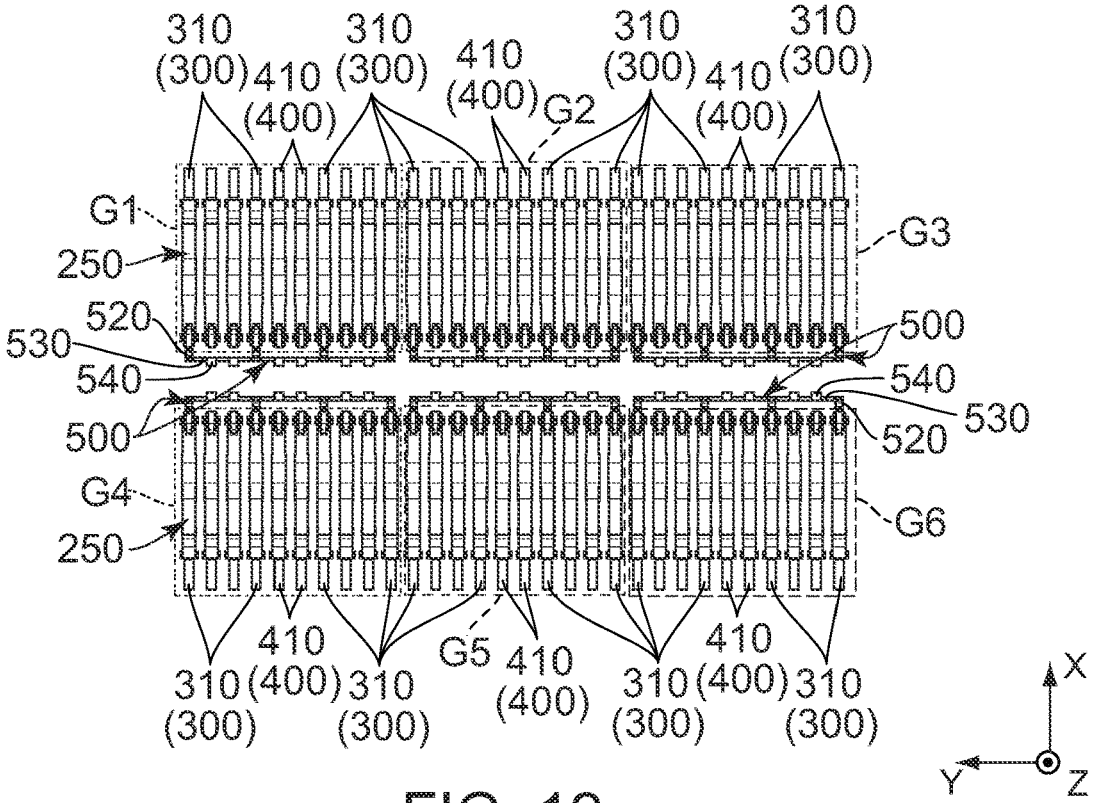
FIG. 12 is a top view showing contacts and the ground members which are included in the floating connector of FIG. 11.

As shown in FIGS. 9 and 10, each of the contacts 250 of the present embodiment is made of metal. The contacts 250 have shapes same as each other. As shown in FIG. 12, the contacts 250 are arranged in two rows which are arranged in the width direction. The contacts 250 of each of the rows are arranged in the pitch direction. The contacts 250 are grouped into a plurality of groups G1, G2, G3, G4, G5, and G6. The number of the contacts 250 of each of the groups G1, G2, G3, G4, G5, and G6 is ten.

As shown in FIG. 12, the contacts 250 include a plurality of ground contacts 300 and a plurality of signal contacts 400. However, the present invention is not limited thereto. The number of the signal contact 400, which is included in the contacts 250, may be one. In other words, the contacts 250 should include the plurality of ground contacts 300 and at least one signal contact 400.

As shown in FIG. 12, the ground contacts 300 of the present embodiment are grouped into the groups G1, G2, G3, G4, G5, and G6. The number of the ground contacts 300 of each of the groups G1, G2, G3, G4, G5, and G6 is four.

Figure 19:
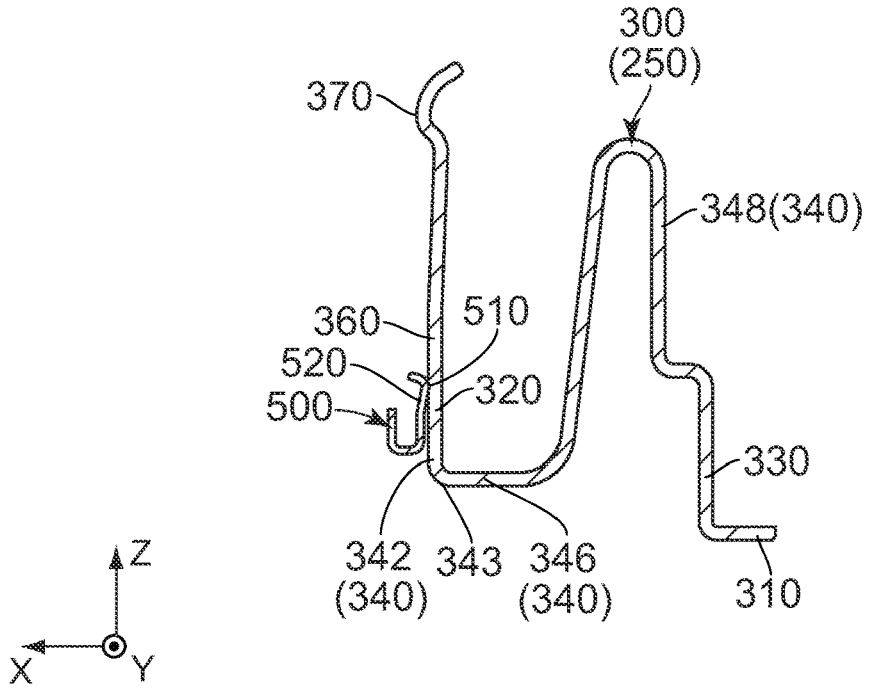
FIG. 19 is a cross-sectional view showing the contact and the ground member of FIG. 17, taken along line F-F.

As shown in FIG. 19, each of the ground contacts 300 is a spring contact. Each of the ground contacts 300 has a fixed portion 310, a first held portion 320, a third held portion 330, a coupling portion 340, an extending portion 360 and a contact portion 370.

As shown in FIG. 6, the fixed portion 310 of the present embodiment is fixed to the circuit board 700 by soldering or the like when the floating connector 100 is mounted on the circuit board 700. The fixed portion 310 extends outward in the width direction from the third held portion 330. The fixed portion 310 defines an outer end of the ground contact 300 in the width direction.

Figure 15:
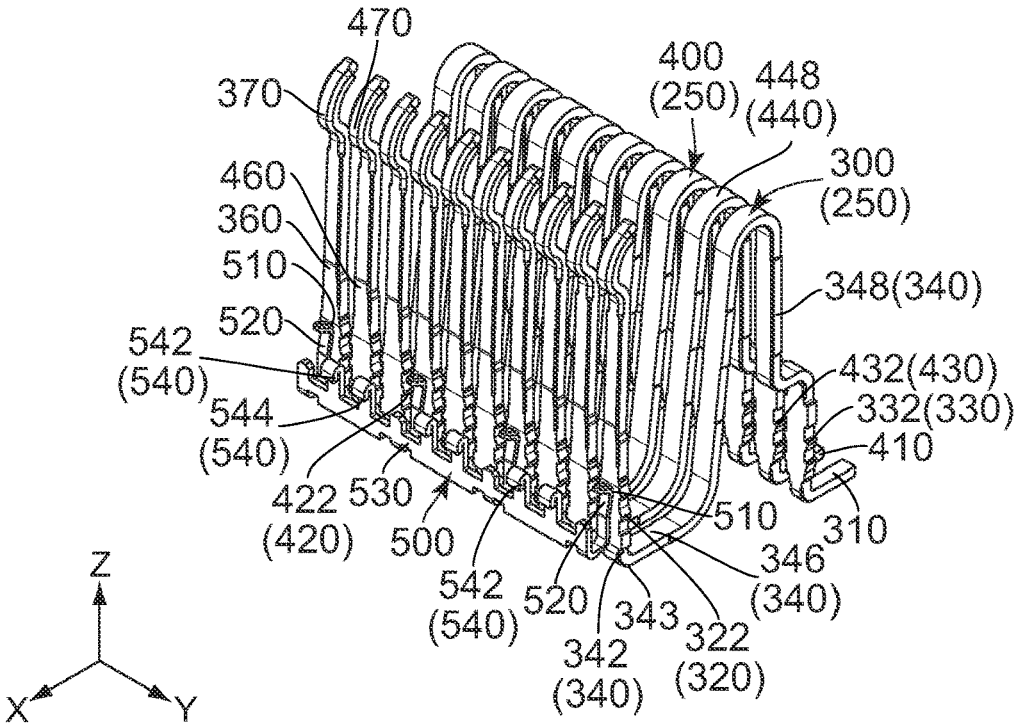
FIG. 15 is a perspective view showing the contacts and the ground member which are included in the contacts and the ground members of FIG. 12 and which are positioned at a rear part of floating connector.

As shown in FIG. 10, the first held portion 320 of the present embodiment extends upward in the up-down direction. The first held portion 320 is held by the first holding portion 202. More specifically, the first held portion 320 is press-fit into the first holding portion 202. As shown in FIG. 15, the first held portion 320 has protrusions 322 each protruding outward in the pitch direction. Referring to FIGS. 10 and 15, the protrusion 322 bites into the inner wall of the ditch of the first holding portion 202. Even during floating action of the movable housing 200, the first held portion 320 is not deformed and is immovable relative to the ground member 500.

As shown in FIG. 10, the third held portion 330 of the present embodiment extends upward in the up-down direction from the fixed portion 310. The third held portion 330 is held by the third holding portion 226. More specifically, the third held portion 330 is press-fit into the third holding portion 226. As shown in FIG. 15, the third held portion 330 has protrusions 332 each protruding outward in the pitch direction. Referring to FIGS. 10 and 15, the protrusion 332 bites into the inner wall of the third holding portion 226.

As shown in FIG. 10, the coupling portion 340 of the present embodiment couples the fixed portion 310 and the first held portion 320 with each other. The coupling portion 340 is resiliently deformable. The movable housing 200 is movable within a predetermined range PA in the plane perpendicular to the up-down direction by the resilient deformation of the coupling portion 340. The coupling portion 340 has a first portion 342, a second portion 346 and a connecting portion 348. However, the present invention is not limited thereto. The coupling portion 340 should have at least the first portion 342 and the second portion 346.

As shown in FIG. 10, the first portion 342 of the present embodiment extends downward in the up-down direction from the first held portion 320. The first portion 342 is positioned in the vicinity of the first held portion 320. Thus, during the floating action of the movable housing 200, the first portion 342 is hardly deformed and is substantially immovable relative to the ground member 500.

As shown in FIG. 10, the second portion 346 of the present embodiment extends in the width direction perpendicular to the up-down direction from a lower end 343 of the first portion 342. More specifically, the second portion 346 extends outward in the width direction from the lower end 343 of the first portion 342. The second portion 346 is positioned around the first held portion 320. Thus, the second portion 346 is hardly deformed during the floating action of the movable housing 200.

As shown in FIG. 10, the connecting portion 348 of the present embodiment connects the second portion 346 and the fixed portion 310 with each other. An upper end of the connecting portion 348 is positioned above the first held portion 320.

As shown in FIG. 10, the extending portion 360 of the present embodiment extends upward in the up-down direction from the first held portion 320. The extending portion 360 is resiliently deformable. The extending portion 360 is positioned in the accommodating portion 208. The extending portion 360 is positioned above the bottom portion 201 in the up-down direction.

As shown in FIG. 6, the contact portion 370 of the present embodiment is brought into contact with the mating contact portion 610 when the floating connector 100 is mated with the mating connector 600. More specifically, when the floating connector 100 is mated with the mating connector 600, the contact portion 370 is brought into contact with the mating contact portion 610 at two points. The contact portion 370 is positioned in the accommodating portion 208. The contact portion 370 is supported by the extending portion 360. Since the extending portion 360 is resiliently deformable as describe above, the contact portion 370 is movable in the width direction.

Referring to FIG. 9, each of the signal contacts 400 of the present embodiment is used for high-speed signal transmission. Referring to FIGS. 9 and 10, the signal contact 400 has a shape same as a shape of the ground contact 300.

Figure 13:
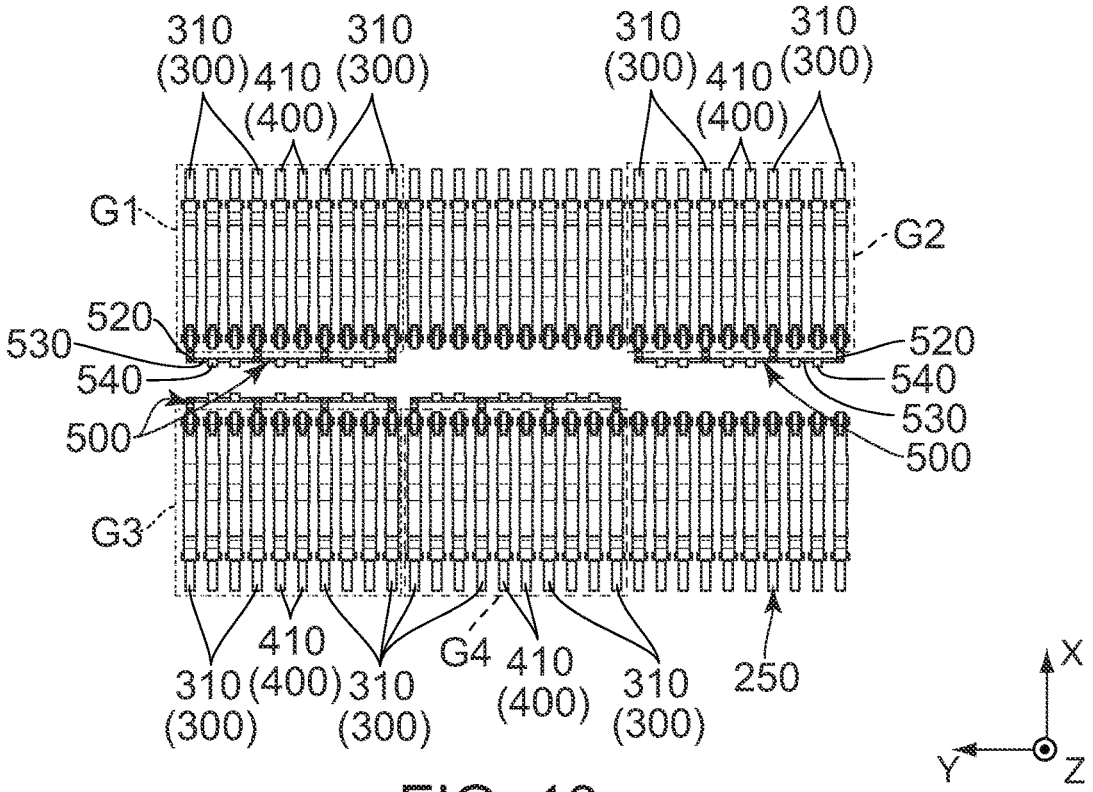
FIG. 13 is a top view showing a first modification of the contacts and the ground members of FIG. 12.
Figure 14:
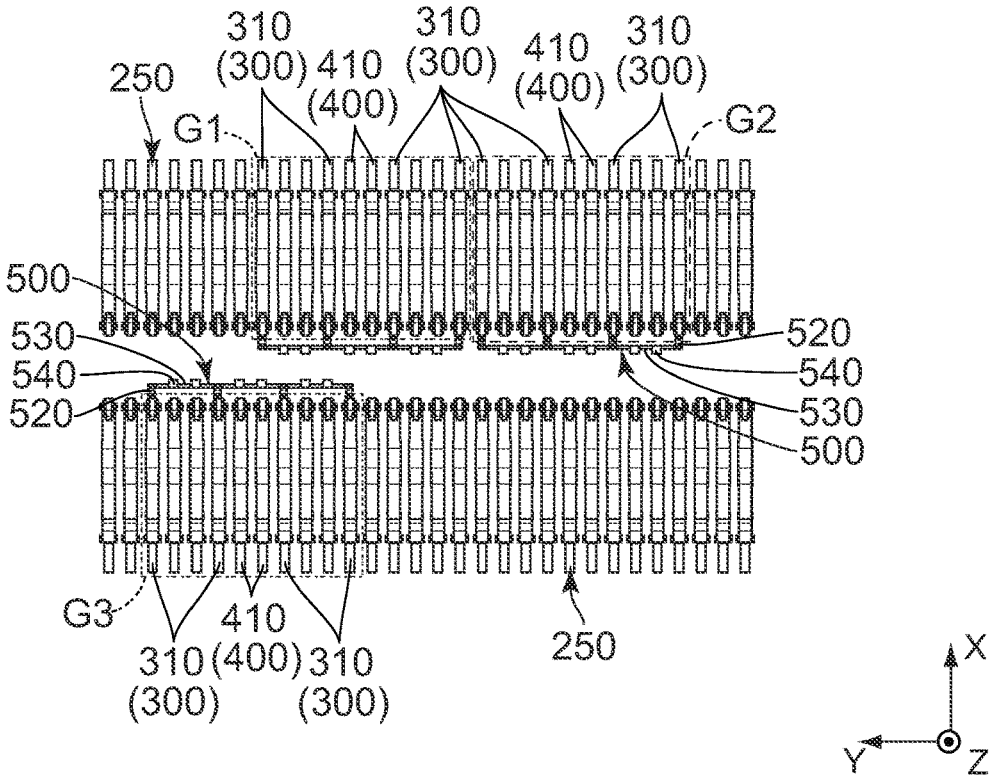
FIG. 14 is a top view showing a second modification of the contacts and the ground members of FIG. 12.

As shown in FIG. 12, the signal contacts 400 of the present embodiment are grouped into the groups G1, G2, G3, G4, G5, and G6. The number of the signal contacts 400 of each of the groups G1, G2, G3, G4, G5, and G6 is six. Since the number of the ground contacts 300 of each of the groups G1, G2, G3, G4, G5, and G6 is four as described above, each of the groups G1, G2, G3, G4, G5, and G6 includes four of the ground contacts 300 and six of the signal contacts 400. However, the present invention is not limited thereto. The contacts 250 should be grouped into one or more groups, provided that each group includes the ground contacts 300 and one or more of the signal contacts 400 which are arranged in the pitch direction. For example, the contacts 250 may be grouped into four groups G1, G2, G3, and G4 such as a first modification of the contacts 250 and the ground members 500 shown in FIG. 13. Additionally, the contacts 250 may be grouped into three groups G1, G2, and G3 such as a second modification of the contacts 250 and the ground members 500 shown in FIG. 14.

Referring to FIG. 12, the contacts 250 of each of the groups G1, G2, G3, G4, G5, and G6 are arranged in differential pairs consisting of G-S-S-G-S-S-G-S-S-G configuration, where "G" is the ground contact 300 and "S" is the signal contact 400.

Figure 18:
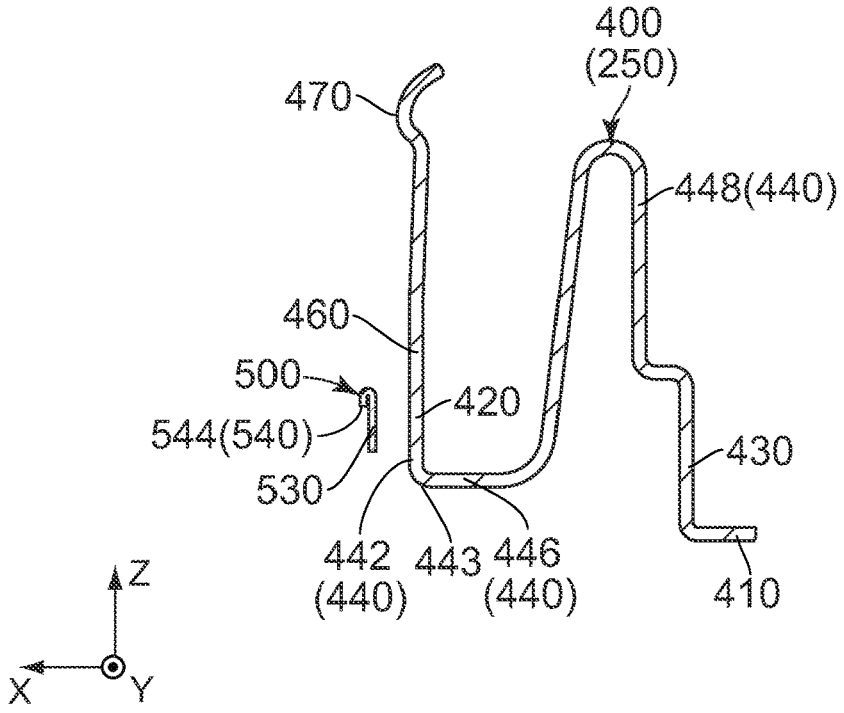
FIG. 18 is a cross-sectional view showing the contact and the ground member of FIG. 17, taken along line E-E.

As shown in FIG. 18, each of the signal contacts 400 is a spring contact. Each of the signal contacts 400 has a fixed portion 410, a first held portion 420, a third held portion 430, a coupling portion 440, an extending portion 460 and a contact portion 470.

As shown in FIG. 4, the fixed portion 410 of the present embodiment is fixed to the circuit board 700 by soldering or the like when the floating connector 100 is mounted on the circuit board 700. The fixed portion 410 extends outward in the width direction from the third held portion 430. The fixed portion 410 defines an outer end of the signal contact 400 in the width direction.

As shown in FIG. 9, the first held portion 420 of the present embodiment extends upward in the up-down direction. The first held portion 420 is held by the first holding portion 202. More specifically, the first held portion 420 is press-fit into the first holding portion 202. As shown in FIG. 15, the first held portion 420 has protrusions 422 each protruding outward in the pitch direction. Referring to FIGS. 9 and 15, the protrusion 422 bites into the inner wall of the ditch of the first holding portion 202. Even during the floating action of the movable housing 200, the first held portion 420 is not deformed and is immovable relative to the ground member 500.

As shown in FIG. 9, the third held portion 430 of the present embodiment extends upward in the up-down direction from the fixed portion 410. The third held portion 430 is held by the third holding portion 226. More specifically, the third held portion 430 is press-fit into the third holding portion 226. As shown in FIG. 15, the third held portion 430 has protrusions 432 each protruding outward in the pitch direction. Referring to FIGS. 9 and 15, the protrusion 432 bites into the inner wall of the third holding portion 226.

As shown in FIG. 9, the coupling portion 440 of the present embodiment couples the fixed portion 410 and the first held portion 420 with each other. The coupling portion 440 is resiliently deformable. The movable housing 200 is movable within the predetermined range PA in the plane perpendicular to the up-down direction by the resilient deformation of the coupling portion 440. The coupling portion 440 has a first portion 442, a second portion 446 and a connecting portion 448. However, the present invention is not limited thereto. The coupling portion 440 should have at least the first portion 442 and the second portion 446.

As shown in FIG. 9, the first portion 442 of the present embodiment extends downward in the up-down direction from the first held portion 420. The first portion 442 is positioned in the vicinity of the first held portion 420. Thus, even during the floating action of the movable housing 200, the first portion 442 is hardly deformed and is substantially immovable relative to the ground member 500.

As shown in FIG. 9, the second portion 446 of the present embodiment extends in the width direction perpendicular to the up-down direction from a lower end 443 of the first portion 442. More specifically, the second portion 446 extends outward in the width direction from the lower end 443 of the first portion 442. The second portion 446 is positioned around the first held portion 420. Thus, the second portion 446 is hardly deformed even during the floating action of the movable housing 200.

As shown in FIG. 9, the connecting portion 448 of the present embodiment connects the second portion 446 and the fixed portion 410 with each other. An upper end of the connecting portion 448 is positioned above the first held portion 420.

As shown in FIG. 9, the extending portion 460 of the present embodiment extends upward in the up-down direction from the first held portion 420. The extending portion 460 is resiliently deformable. The extending portion 460 is positioned in the accommodating portion 208. The extending portion 460 is positioned above the bottom portion 201 in the up-down direction.

As shown in FIG. 4, the contact portion 470 of the present embodiment is brought into contact with the mating contact portion 610 when the floating connector 100 is mated with the mating connector 600. More specifically, when the floating connector 100 is mated with the mating connector 600, the contact portion 470 is brought into contact with the mating contact portion 610 at two points. The contact portion 470 is positioned in the accommodating portion 208. The contact portion 470 is supported by the extending portion 460. Since the extending portion 460 is resiliently deformable as describe above, the contact portion 470 is movable in the width direction.

As shown in FIG. 9, each of the ground members 500 of the present embodiment is attached to the movable housing 200. A method of attaching the ground member 500 to the movable housing 200 is described later. In the present embodiment, none of the ground members 500 is attached to the fixed housing 220. In other words, each of the ground members 500 is attached only to the movable housing 200.

Figure 20:
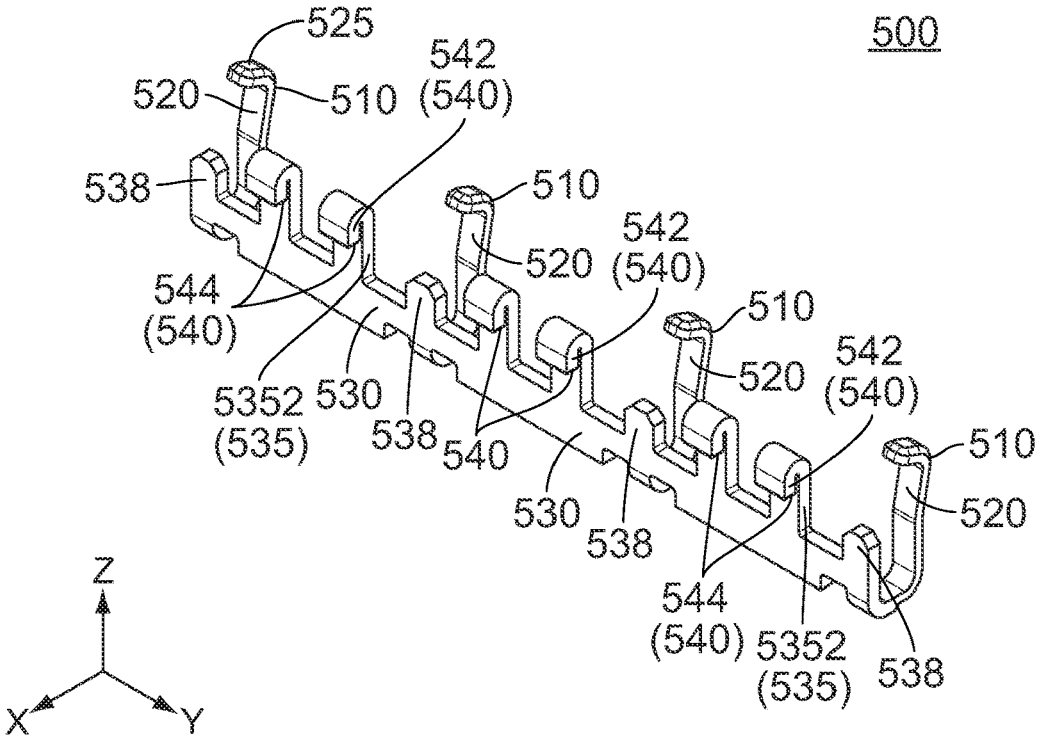
FIG. 20 is a front, perspective view showing the ground member which is included in FIG. 15.

As understood from FIGS. 11 and 20, each of the ground members 500 is distinct and separated from any of the ground contacts 300.

As shown in FIG. 12, in the present embodiment, the number of the ground members 500 is six which is same as the number of the groups G1, G2, G3, G4, G5, and G6 of the ground contacts 300. The groups G1, G2, G3, G4, G5, and G6 of the ground contacts 300 correspond to the ground members 500, respectively. In other words, the groups G1, G2, G3, G4, G5, and G6 of the contacts 250 correspond to the ground members 500, respectively. However, the present invention is not limited thereto. Specifically, as shown in the first modification of FIG. 13, the correspondence of the ground contacts 300 to the ground members 500 may be modified so that the four groups G1, G2, G3, and G4 of the ground contacts 300 correspond to four of the ground members 500, respectively. Additionally, as shown in the second modification of FIG. 14, the correspondence of the ground contacts 300 to the ground members 500 may be modified so that the three groups G1, G2, and G3 of the ground contacts 300 correspond to three of the ground members 500, respectively. In other words, the number of the groups of the ground contacts 300 should be same as the number of the ground members 500.

As described above, each of the ground members 500 of the present embodiment is distinct and separated from any of the ground contacts 300. If groupings of the ground contacts 300 are modified in an assumption where the ground members 500 and the ground contacts 300 be integrally formed with each other to form a single piece, the whole of the single piece must be modified in accordance with the modified groupings of the ground contacts 300. On the contrary, if the groupings of the ground contacts 300 are modified in the floating connector 100 of the present embodiment, the floating connector 100 can manage the modified groupings of the ground contacts 300 by modifying only the ground members 500.

Figure 21:
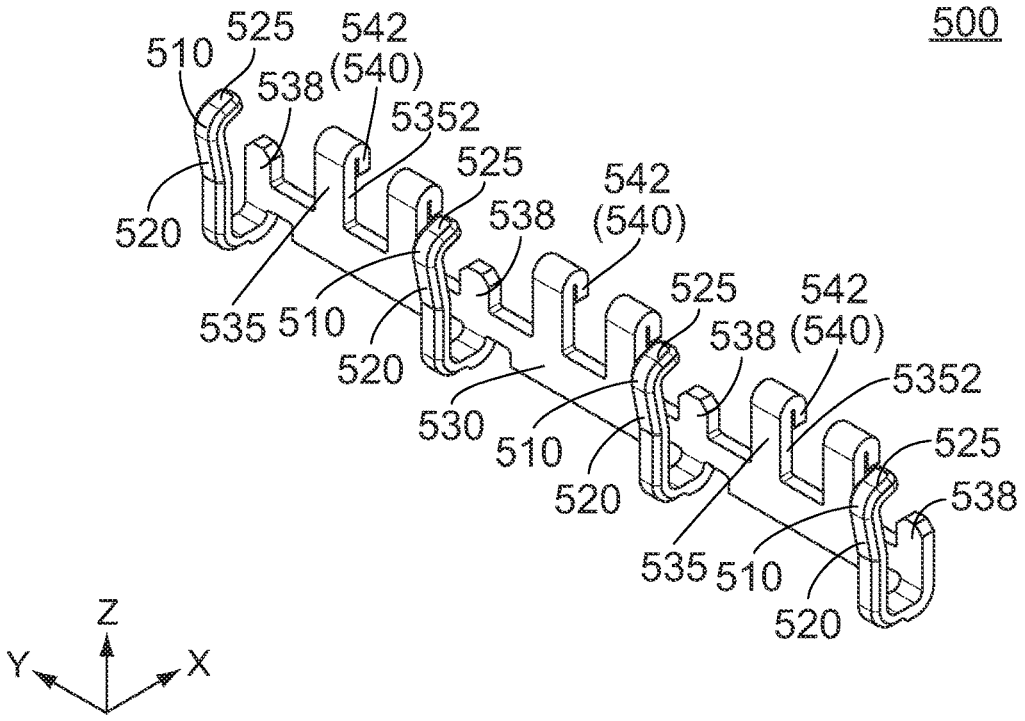
FIG. 21 is a rear, perspective view showing the ground member of FIG. 20.

As shown in FIG. 21, the ground member 500 of the present embodiment has a plurality of ground contact portions 510, a plurality of supporting portions 520, a plurality of guide portions 525, a ground coupling portion 530, a plurality of extending portions 535, a plurality of protruding plate portions 538 and a plurality of second held portions 540. However, the present invention is not limited thereto. The number of the second held portion 540 may be one.

As shown in FIG. 12, the ground contact portions 510 of the present embodiment correspond to the ground contacts 300, respectively. The ground contact portions 510 of each of the ground members 500 are brought into contact with the ground contacts 300, respectively, of the corresponding group G1, G2, G3, G4, G5, G6. Referring to FIG. 10, each of the ground contact portions 510 is brought into contact with the corresponding ground contact 300 even when the movable housing 200 is moved within the predetermined range PA. The ground contact portion 510 is positioned at an upper end of the supporting portion 520 in the up-down direction. The ground contact portion 510 is positioned at the same position as the corresponding ground contact 300 in the pitch direction. The ground contact portion 510 is brought into contact with the first held portion 320. However, the present invention is not limited thereto. The ground contact portion 510 should be brought into contact with the first held portion 320 or with the first portion 342. As described above, the first held portion 320 is not deformed and is immovable relative to the ground member 500. Additionally, as described above, the first portion 342 is hardly deformed and is substantially immovable relative to the ground member 500. Thus, by arranging the ground contact portion 510 to be brought into contact with the first held portion 320 or with the first portion 342, the ground contact portion 510 can be brought into reliable contact with the ground contact 300 even during the floating action of the movable housing 200.

As shown in FIGS. 20 and 21, each of the supporting portions 520 of the present embodiment is bent from the ground coupling portion 530 to extend outward in the width direction, and is then bent to extend upward in the up-down direction. Each of the supporting portions 520 is resiliently deformable independently of each other. The supporting portion 520 supports the ground contact portion 510. More specifically, the supporting portions 520 correspond to the ground contact portions 510, respectively. Each of the supporting portions 520 supports the corresponding ground contact portion 510. The supporting portion 520 defines a lower end of the ground member 500.

As described above, each of the ground contact portions 510 of the single ground member 500 is supported by the corresponding supporting portion 520 which is resiliently deformable independently of each other. Thus, each of the ground contact portions 510 can be brought into reliable and stable contact with the corresponding ground contact 300 even when the movable housing 200 is moved within the predetermined range PA.

Figure 24:
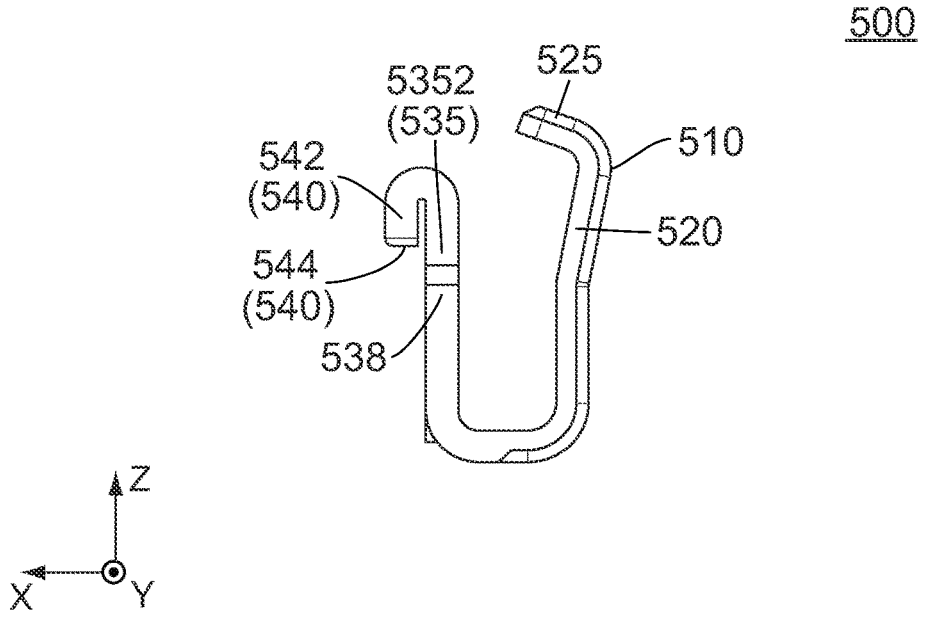
FIG. 24 is a side view showing the ground member of FIG. 20.

As shown in FIG. 21, the guide portions 525 of the present embodiment correspond to the supporting portions 520, respectively. As shown in FIG. 24, each of the guide portions 525 extends upward in the up-down direction and inward in the width direction from an upper end of the corresponding supporting portion 520.

As shown in FIG. 20, the ground coupling portion 530 of the present embodiment has a flat-plate shape intersecting with the width direction. The ground coupling portion 530 extends long in the pitch direction. The ground coupling portion 530 couples the supporting portions 520 with each other.

As shown in FIG. 21, each of the extending portions 535 of the present embodiment extends upward from the ground coupling portion 530. Two of the extending portions 535 are positioned between the supporting portions 520 in the pitch direction. As shown in FIG. 9, the extending portion 535 is positioned in the inserting hole 203. The extending portion 535 is positioned outward of the flat surface 2036 of the inserting hole 203 in the width direction. The extending portion 535 is brought into contact with the flat surface 2036 of the inserting hole 203 in the width direction. The extending portion 535 is positioned at the same position as the signal contact 400 in the pitch direction. Referring to FIG. 21, the extending portion 535 has two side surfaces 5352.

As shown in FIG. 21, each of the side surfaces 5352 of the present embodiment is a plane intersecting with the pitch direction. The side surfaces 5352 define opposite outside ends, respectively, of the extending portion 535 in the pitch direction. Referring to FIGS. 9 and 21, the side surface 5352 faces the wall surface 2032 in the pitch direction. More specifically, the side surface 5352, which is positioned at a positive Y-side of the extending portion 535, faces the wall surface 2032, which is positioned at a positive Y-side of the inserting hole 203, in the pitch direction. Similarly, the side surface 5352, which is positioned at a negative Y-side of the extending portion 535, faces the wall surface 2032, which is positioned at a negative Y-side of the inserting hole 203, in the pitch direction.

Figure 22:
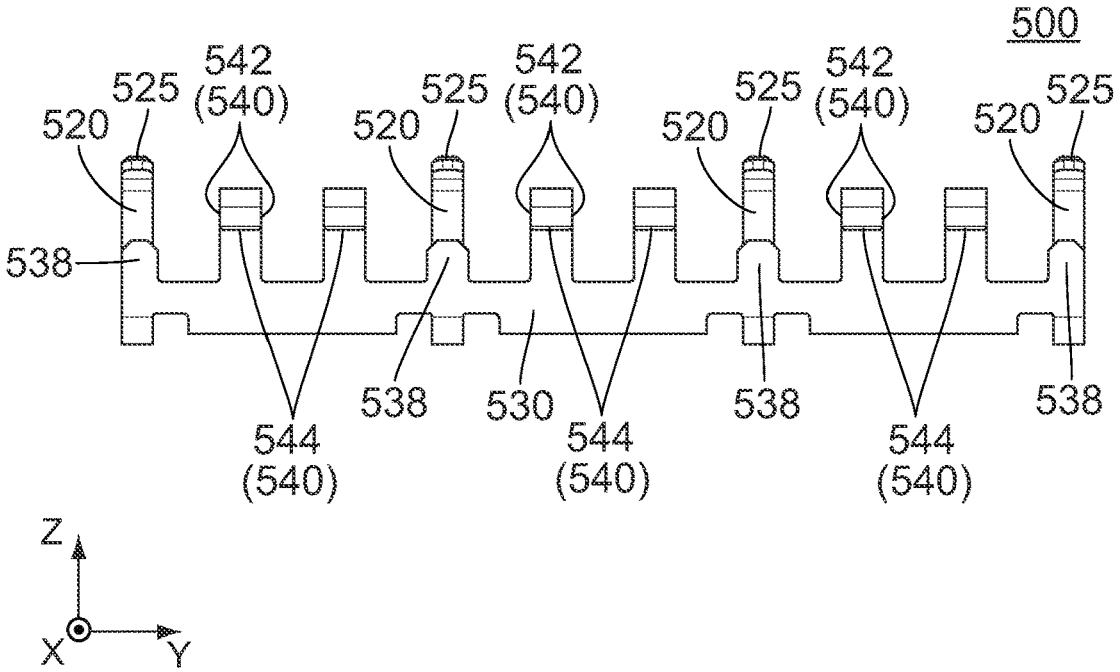
FIG. 22 is a front view showing the ground member of FIG. 20.
Figure 23:
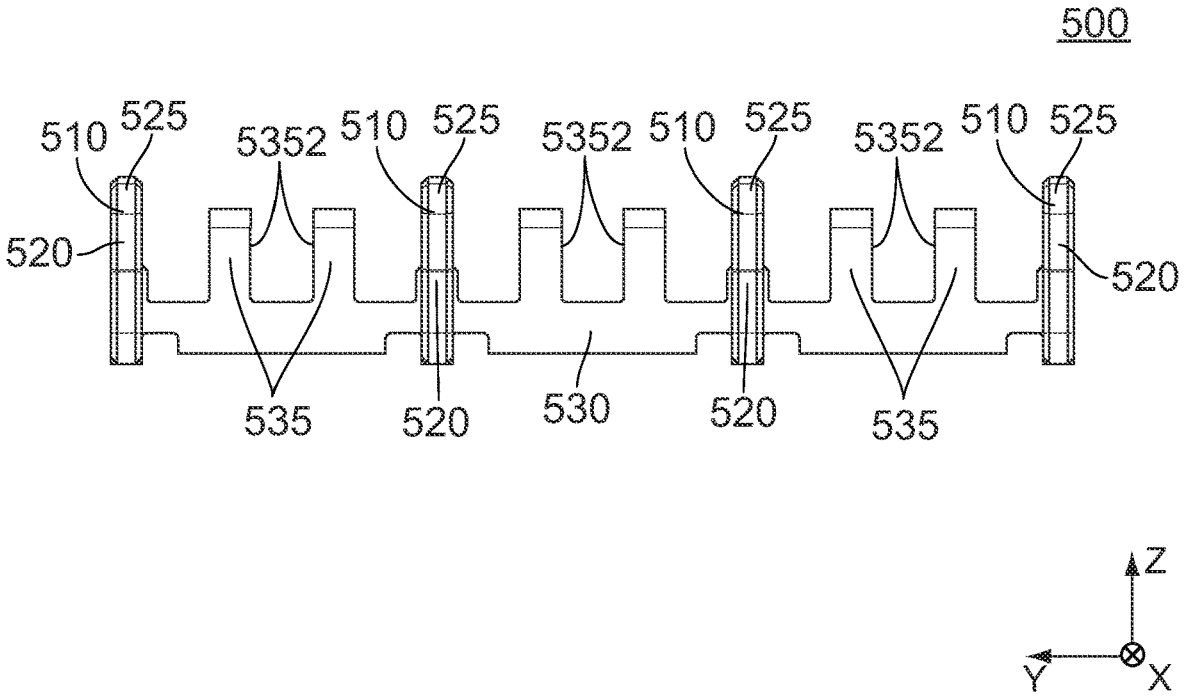
FIG. 23 is a rear view showing the ground member of FIG. 20.

As shown in FIG. 20, each of the protruding plate portions 538 of the present embodiment has a flat-plate shape intersecting with the width direction. Each of the protruding plate portions 538 extends upward from the ground coupling portion 530. As understood from FIGS. 20 and 22, the protruding plate portion 538 is positioned at the same position as the ground contact portion 510 in the pitch direction. The protruding plate portion 538 is positioned at the same position as the supporting portion 520 in the pitch direction. As shown in FIG. 10, the protruding plate portion 538 is brought into contact with the flat surface 2036 of the inserting hole 203 in the width direction.

As shown in FIGS. 20 and 21, the second held portions 540 of the present embodiment correspond to the extending portions 535, respectively. Each of the second held portions 540 extends upward from the corresponding extending portion 535, and is then bent to extend downward. The second held portion 540 is provided between the supporting portions 520 in the pitch direction perpendicular to the up-down direction. More specifically, the second held portions 540, which correspond to the two extending portions 535, respectively, are positioned between the supporting portions 520 in the pitch direction. Referring to FIG. 9, the second held portion 540 is positioned at the same position as the signal contact 400 in the pitch direction. The second held portion 540 is positioned in the inserting hole 203. The second held portion 540 is held by the second holding portion 204. More specifically, the second held portions 540 correspond to the second holding portions 204, respectively, and each of the second held portions 540 is held by the second holding portion 204 corresponding thereto. In other words, the second holding portion 204 is provided to correspond to the second held portion 540. The second held portion 540 is engaged with the second holding portion 204. However, the present invention is not limited thereto. The second held portion 540 may be press-fit into the second holding portion 204.

As shown in FIGS. 20 and 21, the second held portion 540 has two side surfaces 542 and a lower surface 544.

As shown in FIGS. 20 and 21, each of the side surfaces 542 of the present embodiment is a plane intersecting with the pitch direction. The side surfaces 542 define opposite outside ends, respectively, of the second held portion 540 in the pitch direction. Referring to FIGS. 5 and 24, the side surface 542 faces the side wall 2042 of the second holding portion 204 in the pitch direction. More specifically, the side surface 542, which is positioned at a positive Y-side of the second held portion 540, faces the side wall 2042, which is positioned at a positive Y-side of the corresponding second holding portion 204, in the pitch direction. Similarly, the side surface 542, which is positioned at a negative Y-side of the second held portion 540, faces the side wall 2042, which is positioned at a negative Y-side of the corresponding second holding portion 204, in the pitch direction.

As shown in FIG. 24, the lower surface 544 of the present embodiment is a surface which faces downward in the up-down direction. The lower surface 544 is positioned at an outer end of the ground member 500 in the width direction. As shown in FIG. 9, the lower surface 544 faces the bottom surface 2044 of the second holding portion 204 in the up-down direction. More specifically, the lower surface 544 of the second held portion 540 faces the bottom surface 2044 of the corresponding second holding portion 204 in the up-down direction.

As described above, the side surface 542 of the second held portion 540 faces the side wall 2042 of the second holding portion 204 in the pitch direction. In other words, movement of the ground member 500 in the pitch direction is regulated by the side surfaces 542 of the second held portion 540. Thus, the ground contact portion 510 can be brought into reliable contact with the ground contact 300 while prevented from being misaligned relative to the ground contact 300 in the pitch direction.

A Method of Attaching the Ground Member to the Movable Housing

Hereinafter, description will be made in detail about a method of attaching the ground member 500 to the movable housing 200.

Figure 25:
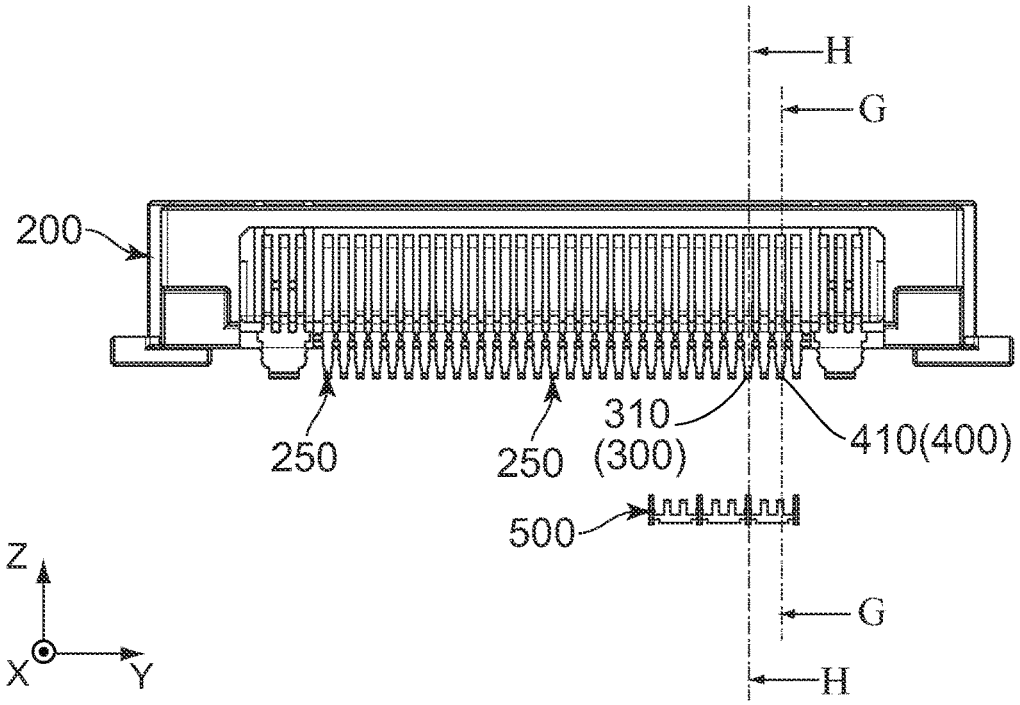
FIG. 25 is a front view for explaining a method of attaching the ground member to the movable housing in the floating connector of FIG. 8.
Figure 26:
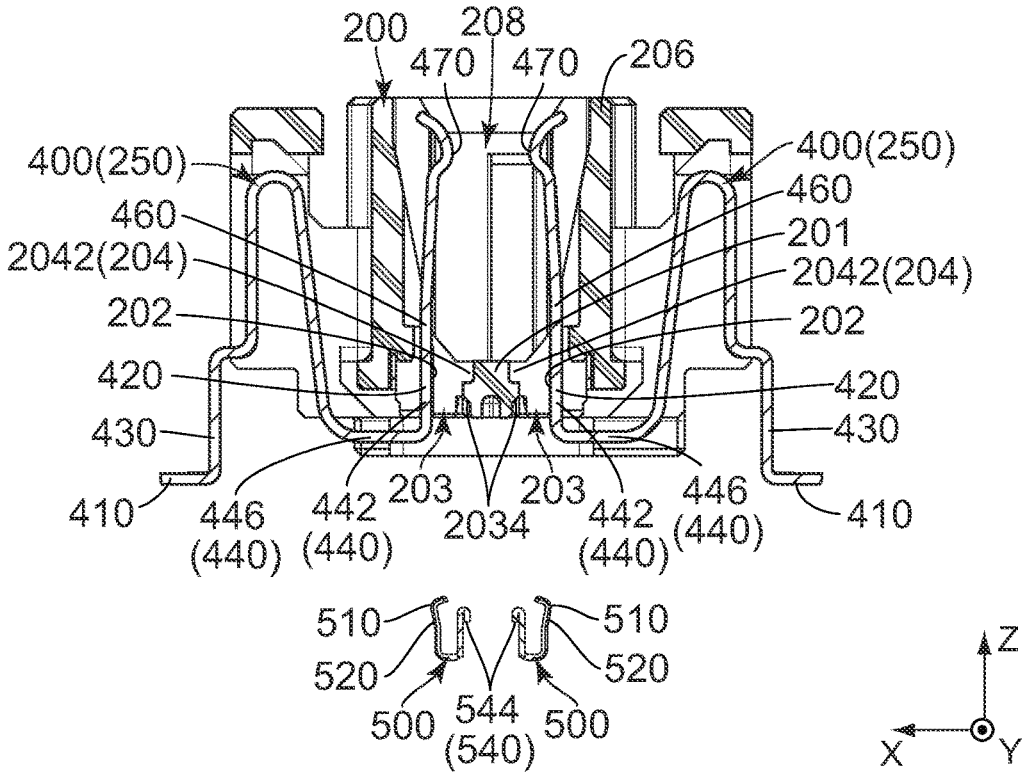
FIG. 26 is a cross-sectional view showing the floating connector of FIG. 25, taken along line G-G.
Figure 27:
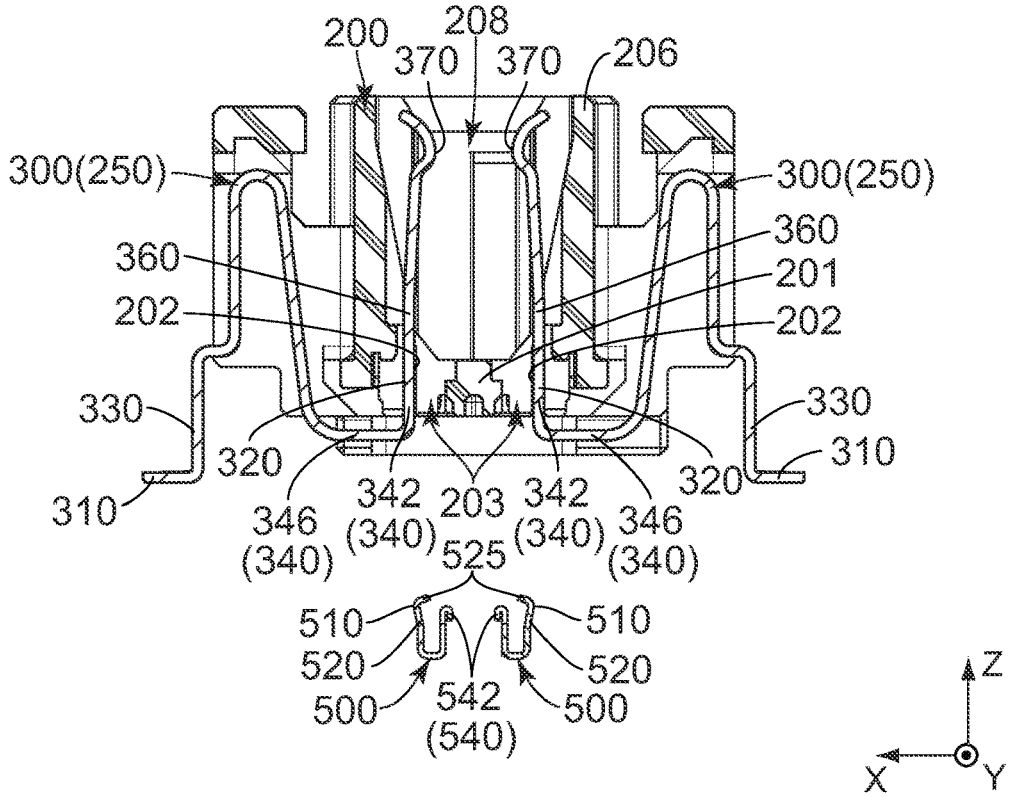
FIG. 27 is a cross-sectional view showing the floating connector of FIG. 25, taken along line H-H.
Figure 28:
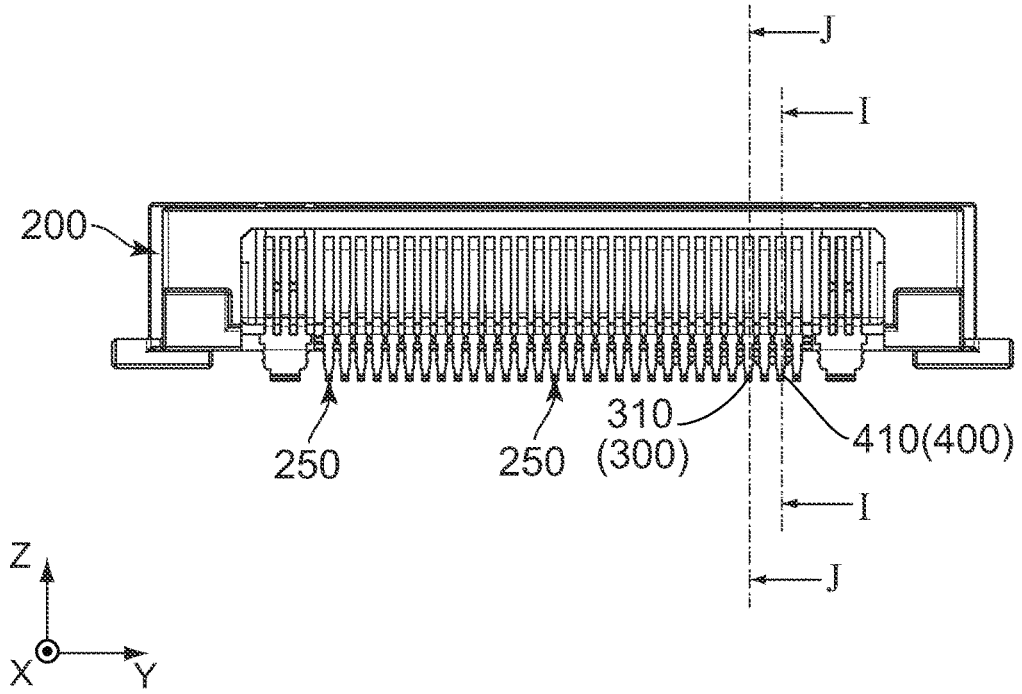
FIG. 28 is another front view for explaining the method of attaching the ground member to the movable housing in the floating connector of FIG. 8.

First, referring to FIGS. 25, 26 and 27, the ground member 500 is arranged below the movable housing 200 to which the contacts 250 are pre-attached. At this time, the second held portion 540 of the ground member 500 is positioned just below one of the inserting holes 203 of the movable housing 200 while the guide portion 525 of the ground member 500 is positioned just below another of the inserting holes 203 of the movable housing 200.

Figure 16:
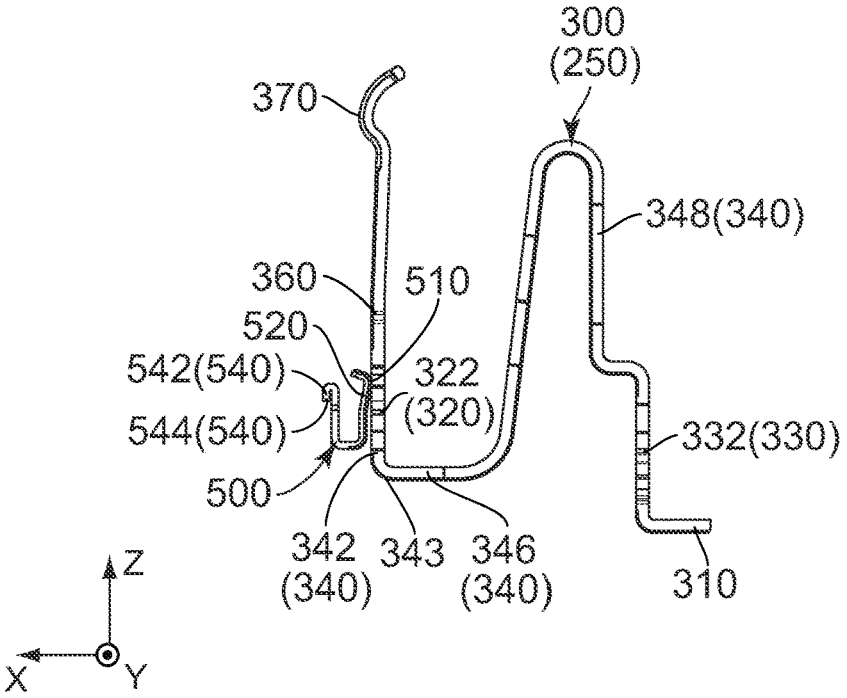
FIG. 16 is a side view showing the contact and the ground member of FIG. 15.
Figure 17:
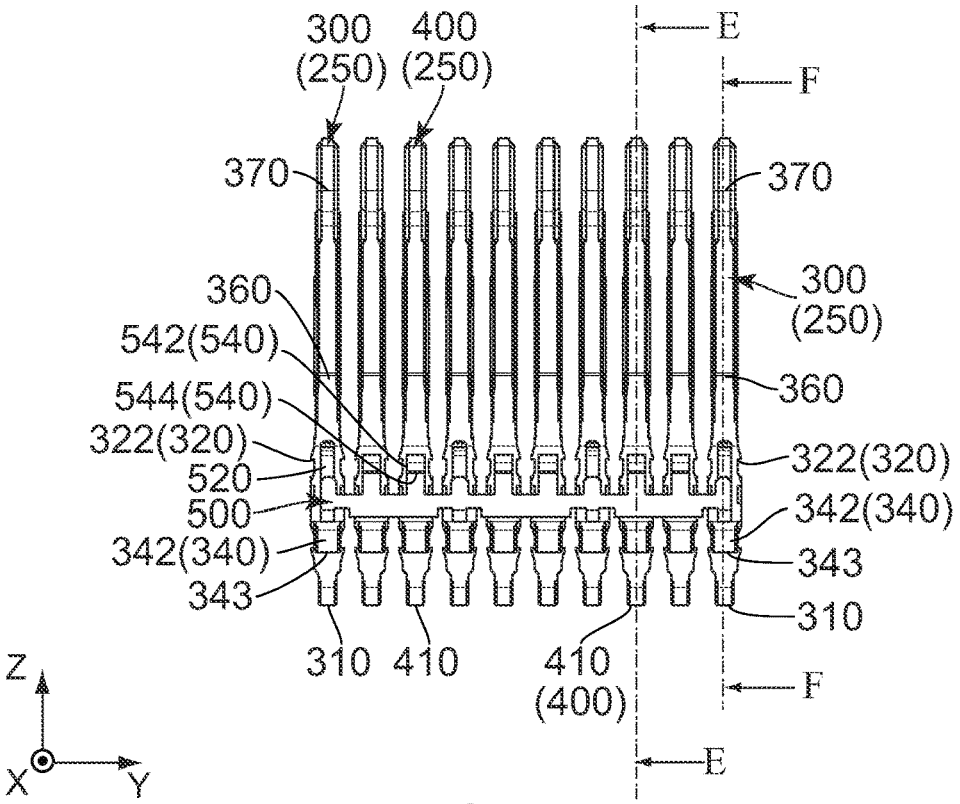
FIG. 17 is a front view showing the contacts and the ground member of FIG. 15.

After that, the ground member 500 is moved upward relative to the movable housing 200. Then, the guide portion 525 of the ground member 500 is brought into contact with the lower end 343 (see FIG. 16) of the coupling portion 340 of the ground contact 300.

Figure 29:
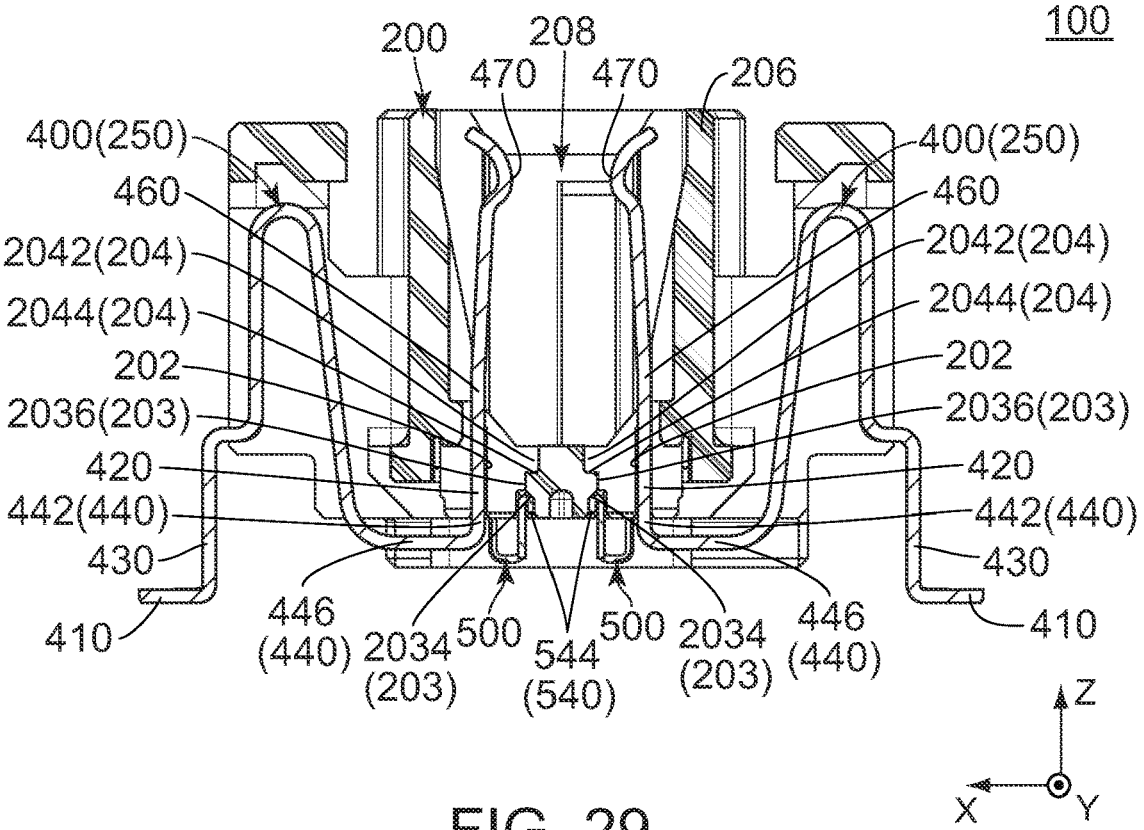
FIG. 29 is a cross-sectional view showing the floating connector of FIG. 28, taken along line I-I.
Figure 30:
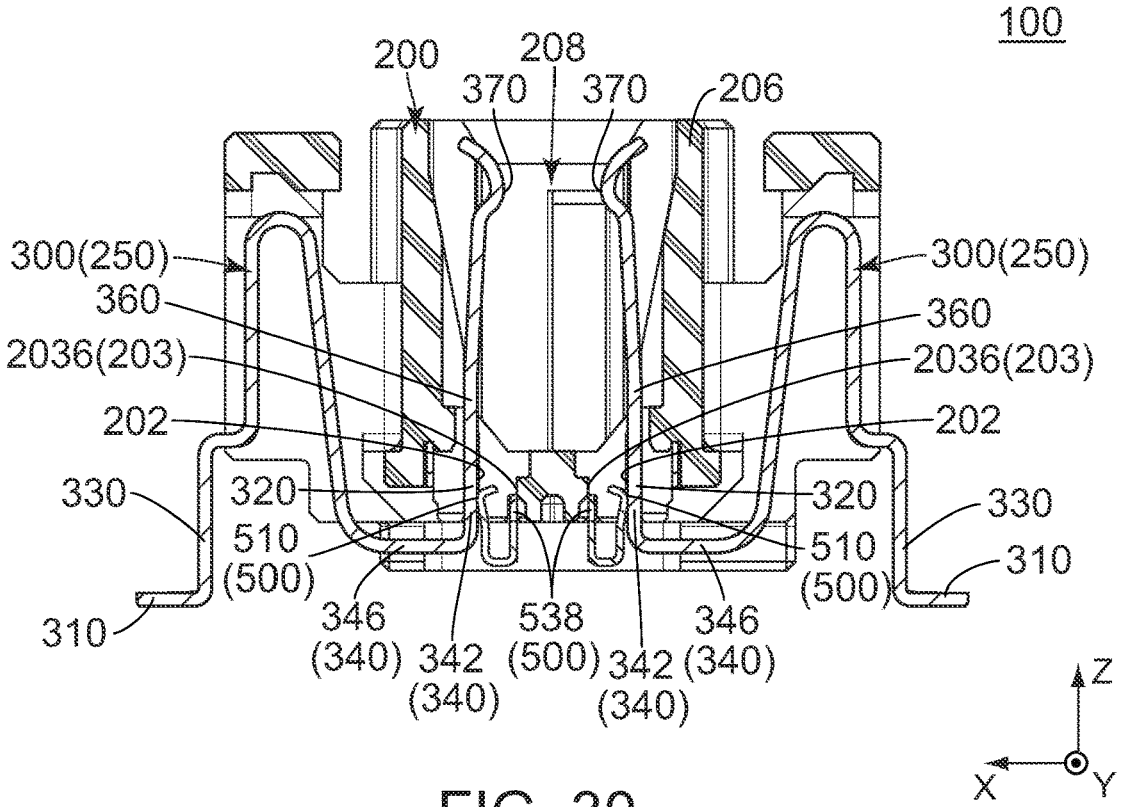
FIG. 30 is a cross-sectional view showing the floating connector of FIG. 28, taken along line J-J.

When upward force is applied to the ground member 500 in this state, the second held portion 540 is inserted into the one of the inserting holes 203 while the supporting portion 520 is inserted into the another of the inserting holes 203. Thus, the ground member 500 results in a state shown in each of FIGS. 29 and 30.

At this time, the ground contact portion 510 of the ground member 500 is in contact with the first held portion 320 of the ground contact 300 while the supporting portion 520 of the ground member 500 is resiliently deformed inward in the width direction. Additionally, at this time, the second held portion 540 of the ground member 500 is in contact with the oblique surface 2034 of the inserting hole 203 of the movable housing 200 while the wall surface 2032 of the inserting hole 203 is positioned outward of the side surface 542 of the second held portion 540 in the pitch direction.

After that, the upward force is further applied to the ground member 500. Then, the second held portion 540 of the ground member 500 rides over the flat surface 2036 of the inserting hole 203 and is accommodated in the second holding portion 204. In other words, the ground member 500 results in a state shown in each of FIGS. 9 and 10. Thus, the ground member 500 is attached to the movable housing 200.

As described above, the movable housing 200 of the present embodiment has the wall surface 2032 and the side wall 2042 which are flush with each other. Thus, when the second held portion 540 of the ground member 500 is inserted into the inserting hole 203, the ground contact portion 510 can be accurately arranged relative to the corresponding ground contact 300 while prevented from being misaligned from the corresponding ground contact 300 in the pitch direction.

As described above, the inserting holes 203 of the present embodiment have shapes same as each other. Thus, the second held portion 540 of the ground member 500 can be held by the second holding portion 204 of the inserting hole 203 even if the second held portion 540 of the ground member 500 is inserted into any one of the inserting holes 203.

As described above, the floating connector 100 of the present embodiment comprises the fixed housing 220 which holds the contacts 250, the present invention is not limited thereto. Specifically, the floating connector 100, instead of comprising the fixed housing 220, may comprise a locator which does not hold the contacts 250 and which arranges the contacts 250 in the pitch direction. In the floating connector 100 comprising the locator, the locator can position the contacts 250 in the pitch direction when the contacts 250 are fixed to the circuit board 700 by soldering or the like. The locator, which does not hold the contacts 250, is required to have a strength less than a strength of the fixed housing 220 having the third holding portions 226 which hold the contacts 250. Thus, the locator can be downsized as compared with the fixed housing 220, and the whole of the floating connector 100 with the locator can be downsized.

While the first embodiment of the present invention is described above, the present embodiment may be modified as follows.

First Modification

Figure 31:
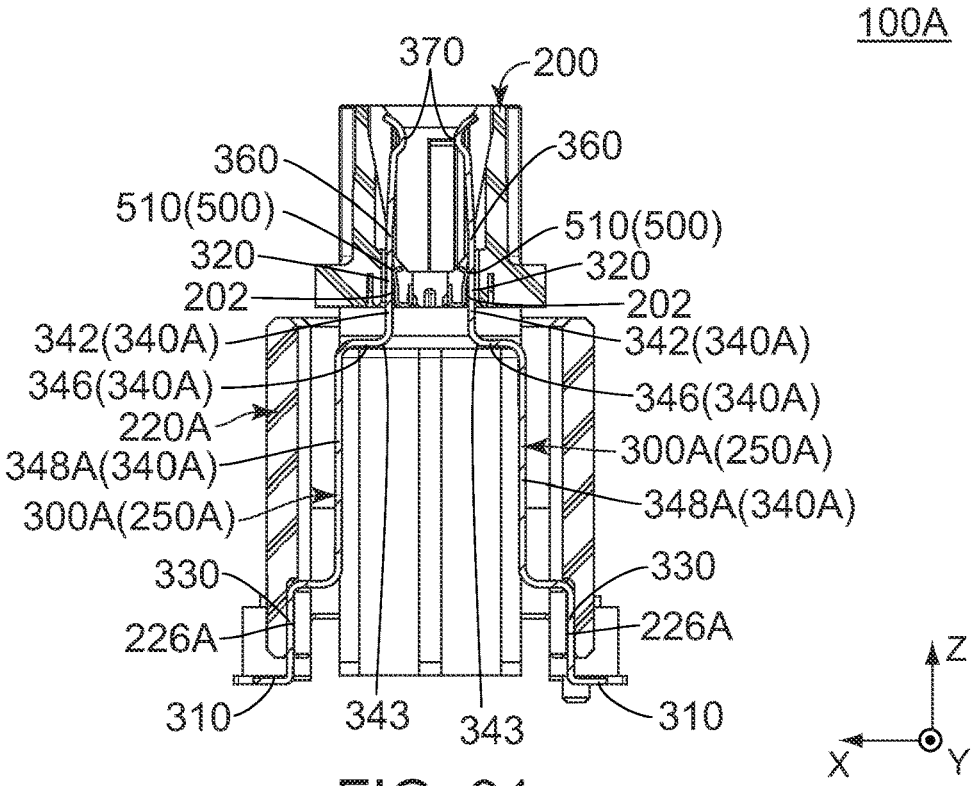
FIG. 31 is a cross-sectional view showing a first modification of the floating connector of FIG. 10.
Figure 32:
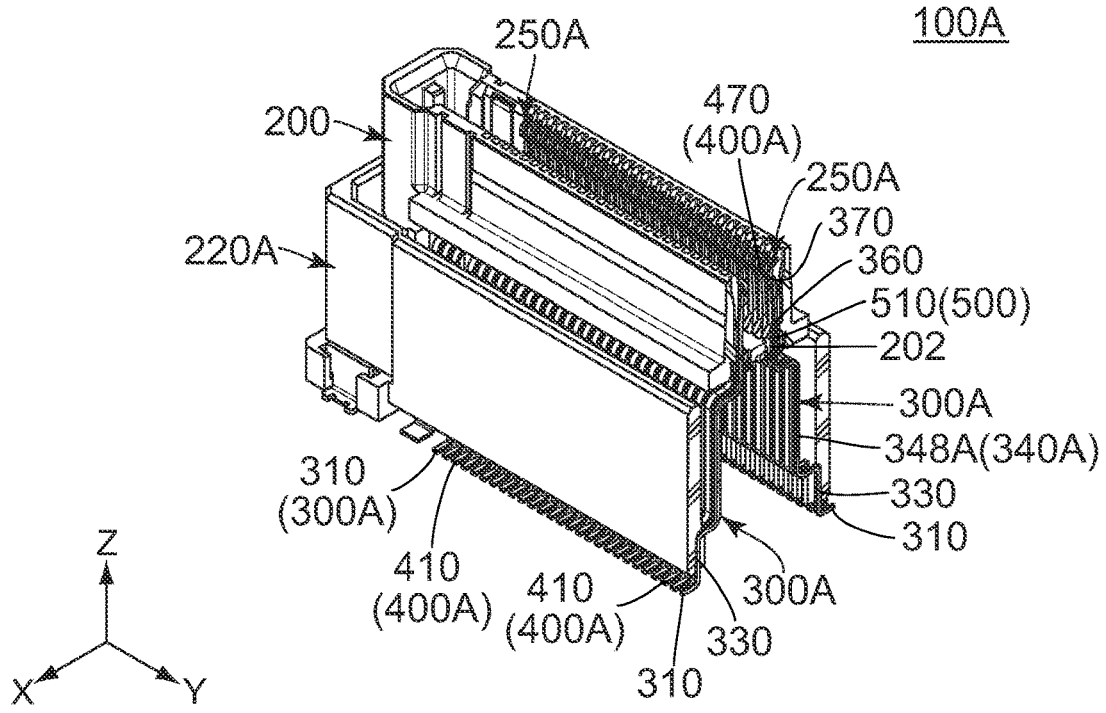
FIG. 32 is a perspective, cross-sectional view showing the floating connector of FIG. 31.

As shown in FIGS. 31 and 32, a floating connector 100A according to a first modification comprises a movable housing 200, a fixed housing 220A, a plurality of contacts 250A and a plurality of ground members 500. Components of the floating connector 100A other than the fixed housing 220A and the contacts 250A have structures same as those of the first embodiment. Accordingly, a detailed description thereabout is omitted.

Referring to FIGS. 31 and 32, the fixed housing 220A of the preset modification is made of insulator. Specifically, the fixed housing 220A has a substantially rectangular tube shape extending in the up-down direction. The fixed housing 220A is positioned below the movable housing 200 in the up-down direction. More specifically, an upper end of the fixed housing 220A is positioned below a lower end of the movable housing 200. The fixed housing 220A has a plurality of third holding portions 226A.

Referring to FIG. 31, the third holding portions 226A of the present modification correspond to the contacts 250A, respectively. Each of the third holding portions 226A is a hole piercing the fixed housing 220A. Each of the third holding portions 226A is positioned around an outer end of the fixed housing 220A in the width direction. Each of the third holding portions 226A has two inner walls each facing inward in the pitch direction.

Referring to FIGS. 31 and 32, each of the contacts 250A of the present modification is made of metal. The contacts 250A have shapes same as each other. The contacts 250A include a plurality of ground contacts 300A and a plurality of signal contacts 400A. However, the present invention is not limited thereto. The number of the signal contact 400A, which is included in the contacts 250A, may be one. In other words, the contacts 250A should include the plurality of ground contacts 300A and at least one signal contact 400A.

As shown in FIG. 31, each of the ground contacts 300A has a fixed portion 310, a first held portion 320, a third held portion 330, a coupling portion 340A, an extending portion 360 and a contact portion 370. Components of the ground contact 300A other than the coupling portion 340A have structures same as those of the ground contact 300 of the first embodiment. Accordingly, a detailed description thereabout is omitted.

As shown in FIG. 31, the coupling portion 340A of the present modification couples the fixed portion 310 and the first held portion 320 with each other. The coupling portion 340A is resiliently deformable. The movable housing 200 is movable within a predetermined range (not shown) in the plane perpendicular to the up-down direction by the resilient deformation of the coupling portion 340A.

As shown in FIG. 31, the coupling portion 340A has a first portion 342, a second portion 346 and a connecting portion 348A.

As shown in FIG. 31, the first portion 342 of the present modification extends downward in the up-down direction from the first held portion 320. A lower end 343 of the first portion 342 is positioned below the upper end of the fixed housing 220A. The lower end 343 of the first portion 342 is positioned below the movable housing 200 in the up-down direction.

As shown in FIG. 31, the second portion 346 of the present modification extends in the width direction perpendicular to the up-down direction from the lower end 343 of the first portion 342. More specifically, the second portion 346 extends outward in the width direction from the lower end 343 of the first portion 342. The second portion 346 is positioned below the movable housing 200 in the up-down direction.

As shown in FIG. 31, the connecting portion 348A of the present modification connects the second portion 346 and the fixed portion 310 with each other. The connecting portion 348A extends downward in the up-down direction. More specifically, the connecting portion 348A extends downward from the second portion 346, and is bent to extend outward in the width direction, and is further bent to extend downward. The connecting portion 348A is positioned below the first held portion 320 in the up-down direction.

Referring to FIG. 32, the signal contact 400A of the present modification has a shape same as a shape of the ground contact 300A. Each of the signal contacts 400A has a fixed portion 410, a first held portion (not shown), a third held portion (not shown), a coupling portion (not shown), an extending portion (not shown) and a contact portion 470. The fixed portion 410, the first held portion (not shown), the third held portion (not shown), the coupling portion (not shown), the extending portion (not shown) and the contact portion 470 of the signal contact 400A have structures same as those of the fixed portion 310, the first held portion 320, the third held portion 330, the coupling portion 340A, the extending portion 360 and the contact portion 370 of the ground contact 300A. Accordingly, a detailed description thereabout is omitted.

Second Modification

Figure 33:
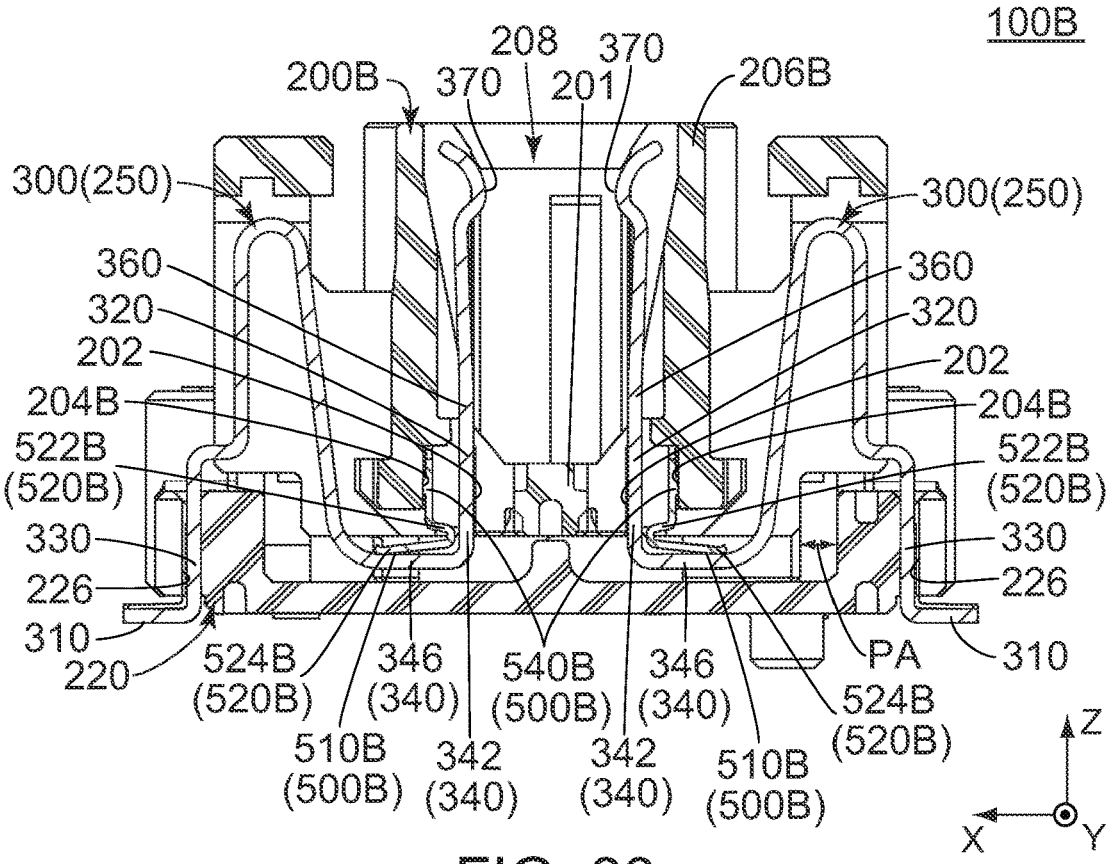
FIG. 33 is a cross-sectional view showing a second modification of the floating connector of FIG. 10.

As shown in FIG. 33, a floating connector 1008 according to a second modification comprises a movable housing 200B, a fixed housing 220, a plurality of contacts 250 and a plurality of ground members 500B. Components of the floating connector 1008 other than the movable housing 200B and the ground member 500B have structures same as those of the first embodiment. Accordingly, a detailed description thereabout is omitted.

Referring to FIG. 33, the movable housing 200B of the preset modification is made of insulator. The movable housing 200B has a surrounding portion 206B, an accommodating portion 208 and a bottom portion 201. Components of the movable housing 200B other than the surrounding portion 206B have structures same as those of the first embodiment. Accordingly, a detailed description thereabout is omitted.

As shown in FIG. 33, the surrounding portion 206B of the present modification has a substantially rectangular tube shape extending in the up-down direction. The surrounding portion 206B has second holding portions 204B. Each of the second holding portions 204B is positioned at a lower end of the surrounding portion 206B.

Referring to FIG. 33, each of the second holding portions 204B of the present modification consists of two ditches each extending in the up-down direction. Each of the ditches of the second holding portion 204B has an inner wall which faces inward in the pitch direction.

Referring to FIG. 33, each of the ground members 500B of the present modification has a plurality of ground contact portions 5108, a plurality of supporting portions 520B, a ground coupling portion (not shown) and a plurality of second held portions 540B.

As shown in FIG. 33, the ground contact portion 5108 of the present modification faces downward in the up-down direction. The ground contact portion 5108 is brought into contact with a second portion 346 of a ground contact 300. More specifically, the ground contact portion 510B is brought into contact the second portion 346 from above. Thus, even during floating action of the movable housing 200B, the ground contact portion 5108 can be brought into contact with the aforementioned hardly deformable part of the ground contact 300, namely, the second portion 346.

As shown in FIG. 33, the supporting portion 520B of the present modification extends downward. The supporting portion 520B has an upper portion 522B and a lower portion 524B. The upper portion 522B extends downward in the up-down direction and inward in the width direction. The lower portion 524B is bent from the upper portion 522B to extend downward in the up-down direction and outward in the width direction. The ground contact portion 5108 is positioned around an outer end of the lower portion 524B in the width direction.

As shown in FIG. 33, the second held portion 540B of the present modification defines an upper end of the ground member 500. The second held portion 540B is held by the second holding portion 204B. More specifically, the second held portion 540B is press-fit into the second holding portion 204B. The second held portions 540B are coupled with each other by the ground coupling portion which is not shown in the figure.

Second Embodiment

Figure 34:
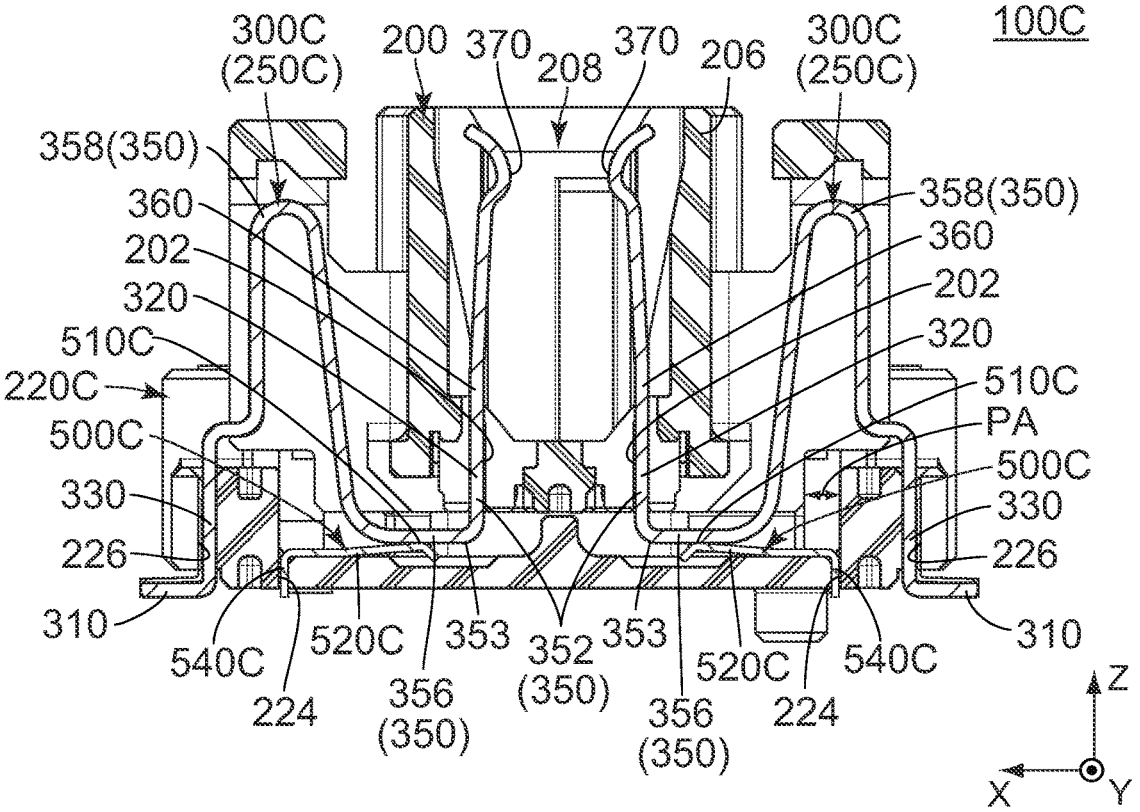
FIG. 34 is a cross-sectional view showing a floating connector which is included in a connector assembly according to a second embodiment of the present invention.
Figure 35:
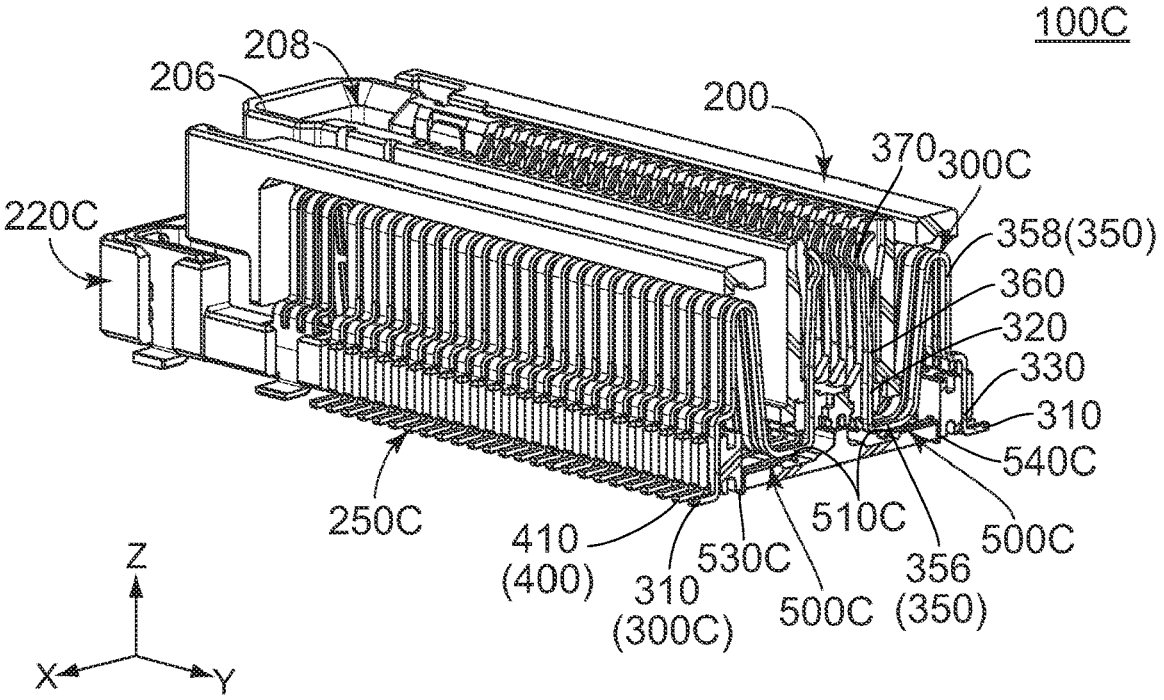
FIG. 35 is a perspective, cross-sectional view showing the floating connector of FIG. 34.
Figure 36:
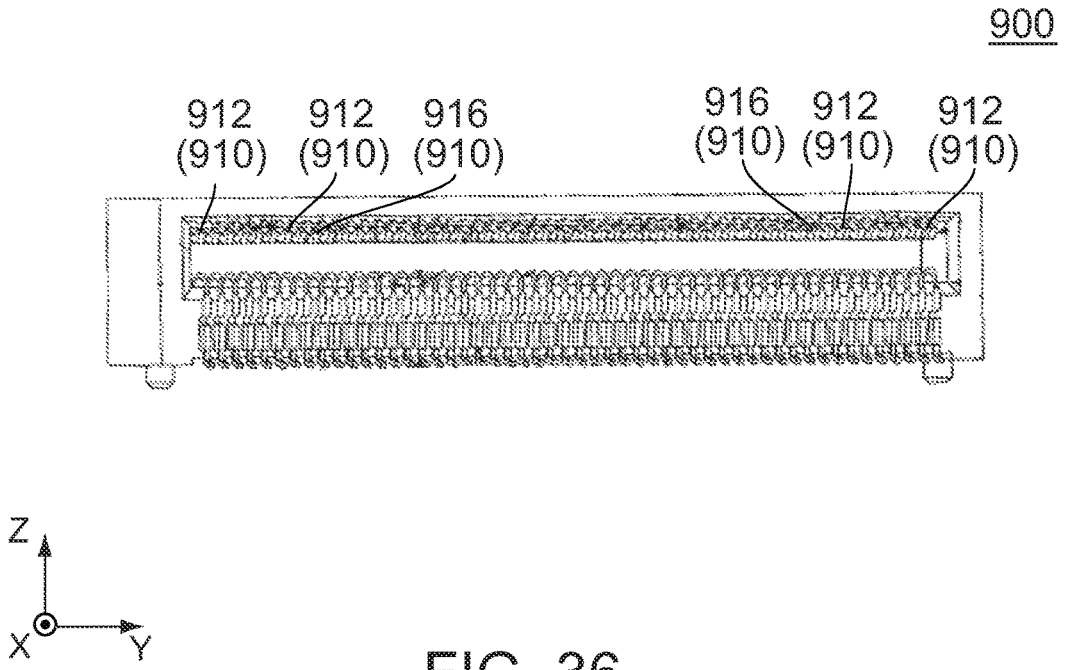
FIG. 36 PRIOR ART
FIG. 36 is a front, perspective view showing a connector of Patent Document 1.
Figure 37:
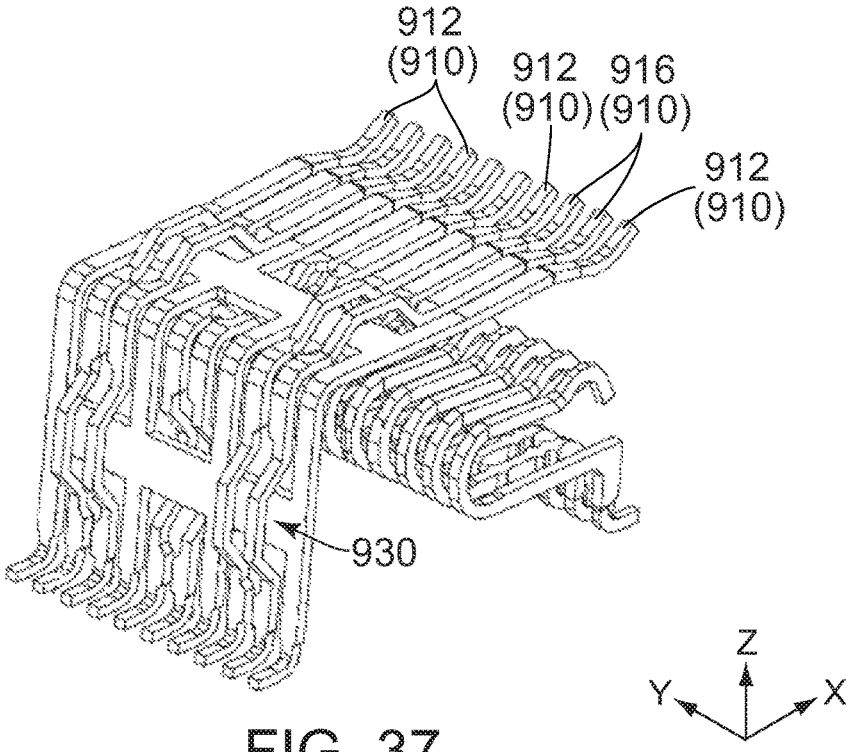
FIG. 37 PRIOR ART
FIG. 37 is a perspective view showing contacts which are included in the connector of FIG. 36.

Referring to FIGS. 34 and 35, a connector assembly (not shown) according to a second embodiment of the present invention comprises a mating connector (not shown) and a floating connector 100C. The mating connector of the present embodiment has a structure similar to that of the mating connector 600 (see FIG. 1) according to the aforementioned first embodiment. Accordingly, a detailed description thereabout is omitted.

As shown in FIGS. 34 and 35, the floating connector 100C of the present embodiment has a structure similar to that of the floating connector 100 (see FIG. 1) according to the aforementioned first embodiment. Components of the floating connector 100C shown in FIGS. 34 and 35 which are same as those of the floating connector 100 of the first embodiment are referred by using reference signs same as those of the floating connector 100 of the first embodiment. As for directions and orientations in the present embodiment, expressions same as those of the first embodiment will be used hereinbelow.

As shown in FIGS. 34 and 35, the floating connector 100C of the present embodiment comprises a movable housing 200, a fixed housing 220C, a plurality of contacts 250C and a plurality of ground members 500C. However, the present invention is not limited thereto. Specifically, the number of the ground member 500C may be one. In other words, the floating connector 100C should comprise the movable housing 200, the fixed housing 220C, the plurality of contacts 250C and at least one ground member 500C. The movable housing 200 of the present embodiment has a structure same as that of the movable housing 200 of the first embodiment. Accordingly, a detailed description thereabout is omitted.

As shown in FIG. 34, the fixed housing 220C of the present embodiment has second holding portions 224 and third holding portions 226.

As shown in FIG. 34, each of the contacts 250C of the present embodiment is made of metal. The contacts 250C include a plurality of ground contacts 300C and a plurality of signal contacts 400. However, the present invention is not limited thereto. The number of the signal contact 400, which is included in the contacts 250C, may be one. In other words, the contacts 250C should include the plurality of ground contacts 300C and at least one signal contact 400.

As shown in FIG. 34, each of the ground contacts 300C of the present embodiment has a fixed portion 310, a first held portion 320, a third held portion 330, a deformable portion 350, an extending portion 360 and a contact portion 370. Components of the ground contact 300C of the present embodiment other than the deformable portion 350 have structures same as those of the ground contact 300 of the first embodiment. Accordingly, a detailed description thereabout is omitted.

As shown in FIG. 34, the deformable portion 350 of the present embodiment couples the first held portion 320 and the third held portion 330 with each other. The deformable portion 350 is resiliently deformable. The movable housing 200 is movable within a predetermined range PA in the plane perpendicular to the up-down direction by the resilient deformation of the deformable portion 350.

As shown in FIG. 34, the deformable portion 350 has a first portion 352, a second portion 356 and a connecting portion 358. However, the present invention is not limited thereto. The deformable portion 350 should have at least the first portion 352 and the second portion 356.

As shown in FIG. 34, the first portion 352 of the present embodiment extends downward in the up-down direction from the first held portion 320. The first portion 352 is positioned in the vicinity of the first held portion 320. Accordingly, even during floating action of the movable housing 200, the first portion 352 is hardly deformed and is substantially immovable relative to the ground member 500C.

As shown in FIG. 34, the second portion 356 of the present embodiment extends in the width direction perpendicular to the up-down direction from a lower end 353 of the first portion 352. More specifically, the second portion 356 extends outward in the width direction from the lower end 353 of the first portion 352. The second portion 356 is positioned around the first held portion 320. Accordingly, the second portion 356 is hardly deformed even during the floating action of the movable housing 200.

As shown in FIG. 34, the connecting portion 358 of the present embodiment couples the second portion 356 and the third held portion 330 with each other. An upper end of the connecting portion 358 is positioned above the first held portion 320.

As shown in FIG. 34, each of the ground members 500C of the present embodiment is attached to the fixed housing 220C. In the present embodiment, none of the ground members 500C is attached to the movable housing 200. In other words, each of the ground members 500C is attached only to the fixed housing 220C.

Referring to FIGS. 34 and 35, each of the ground members 500C has a plurality of ground contact portions 510C, a plurality of supporting portions 520C, a ground coupling portion 530C and second held portions 540C.

Referring to FIG. 34, the ground contact portions 510C of the present embodiment correspond to the ground contacts 300C, respectively. Each of the ground contact portions 510C is brought into contact with the corresponding ground contact 300C even when the movable housing 200 is moved within the predetermined range PA. The ground contact portion 510C is brought into contact with the second portion 356.

Referring to FIGS. 34 and 35, the supporting portions 520C of the present embodiment support the ground contact portions 510C, respectively. Each of the supporting portions 520C extends upward in the up-down direction and inward in the width direction from the ground coupling portion 530C.

Referring to FIGS. 34 and 35, the ground coupling portion 530C of the present embodiment couples the supporting portions 520C with each other.

As shown in FIG. 34, the second held portion 540C of the present embodiment is held by the second holding portion 224.

Although the specific explanation about the present invention is made above referring to the embodiments, the present invention is not limited thereto and is susceptible to various modifications and alternative forms. In addition, the above embodiments and variations may also be combined.

Although each of the ground contact 300 and the signal contact 400 is the spring contact while the extending portion 360, 460 is resiliently deformable, the present invention is not limited thereto. Specifically, the ground contact 300 may be a blade contact or a pin contact. Similarly, the signal contact 400 may be a blade contact or a pin contact. From a point of view of contact reliability, the ground contact 300 and the signal contact 400 of the present embodiment are, however, preferable because each of the ground contact 300 and the signal contact 400 of the present embodiment can be brought into contact with the mating contact portion 610 at the two points when the floating connector 100 is mated with the mating connector 600, as described above.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A floating connector usable in a state where the floating connector is mounted on a circuit board, the floating connector being mateable with and removable from a mating connector along an up-down direction, wherein:

the mating connector has a mating contact portion;

the floating connector comprises a movable housing, a plurality of contacts, and at least one ground member;

the movable housing has a first holding portion and a second holding portion;

each of the contacts has a fixed portion, a first held portion, a coupling portion, an extending portion, and a contact portion;

the fixed portion is fixed to the circuit board when the floating connector is mounted on the circuit board;

the first held portion is held by the first holding portion;

the coupling portion couples the fixed portion and the first held portion with each other;

the coupling portion is resiliently deformable;

the movable housing is movable within a predetermined range in a plane perpendicular to the up-down direction by the resilient deformation of the coupling portion;

the extending portion extends upward in the up-down direction from the first held portion;

the contact portion is brought into contact with the mating contact portion when the floating connector is mated with the mating connector;

the contact portion is supported by the extending portion;

the contacts include a plurality of ground contacts and a signal contact;

the ground member has a plurality of ground contact portions, a plurality of supporting portions, a ground coupling portion, and a second held portion;

each of the ground contact portions corresponds to a respective one of the ground contacts;

each of the ground contact portions is brought into contact with its corresponding ground contact even when the movable housing is moved within the predetermined range;

each of the supporting portions supports a respective one of the ground contact portions;

the ground coupling portion couples the supporting portions with each other;

the second held portion is held by the second holding portion;

each of the supporting portions is bent from the ground coupling portion to extend outward in a width direction perpendicular to the up-down direction, and is further bent to extend upward in the up-down direction; and the supporting portions are resiliently deformable independently of each other.

2. The floating connector as recited in claim 1, wherein:

the coupling portion has a first portion;

the first portion extends downward in the up-down direction from the first held portion; and the ground contact portion is brought into contact with the first held portion or with the first portion.

3. The floating connector as recited in claim 1, wherein:

the coupling portion has at least a first portion and a second portion;

the first portion extends downward in the up-down direction from the first held portion;

the first portion has a lower end in the up-down direction; and the second portion extends in the width direction from the lower end of the first portion.

4. The floating connector as recited in claim 1, wherein:

the second held portion is provided between the supporting portions in a pitch direction perpendicular to both the up-down direction and the width direction; and the second holding portion is provided to correspond to the second held portion.

5. The floating connector as recited in claim 1, wherein:

the floating connector comprises a plurality of the ground members;

the ground contacts are grouped into a plurality of groups;

each of the groups corresponds to a respective one of the ground members; and the ground contact portion of each of the ground members is brought into contact with the ground contact of its corresponding group.

6. A floating connector usable in a state where the floating connector is mounted on a circuit board, the floating connector being mateable with and removable from a mating connector along an up-down direction, wherein:

the mating connector has a mating contact portion;

the floating connector comprises a movable housing, a fixed housing, a plurality of contacts, and at least one ground member;

the movable housing has a first holding portion;

the fixed housing has a second holding portion and a third holding portion;

each of the contacts has a fixed portion, a first held portion, a third held portion, a deformable portion, an extending portion, and a contact portion;

the fixed portion is fixed to the circuit board when the floating connector is mounted on the circuit board;

the first held portion is held by the first holding portion;

the third held portion is held by the third holding portion;

the deformable portion couples the first held portion and the third held portion with each other;

the deformable portion is resiliently deformable;

the movable housing is movable within a predetermined range in a plane perpendicular to the up-down direction by the resilient deformation of the deformable portion;

the extending portion extends upward in the up-down direction from the first held portion;

the contact portion is brought into contact with the mating contact portion when the floating connector is mated with the mating connector;

the contact portion is supported by the extending portion;

the contacts include a plurality of ground contacts and a signal contact;

the ground member has a plurality of ground contact portions, a plurality of supporting portions, a ground coupling portion, and a second held portion;

each of the ground contact portions corresponds to a respective one of the ground contacts;

each of the ground contact portions is brought into contact with its corresponding ground contact even when the movable housing is moved within the predetermined range;

each of the supporting portions supports a respective one of the ground contact portions;

the ground coupling portion couples the supporting portions with each other; and the second held portion is held by the second holding portion.

7. The floating connector as recited in claim 6, wherein:

the deformable portion has at least a first portion and a second portion;

the first portion extends downward in the up-down direction from the first held portion;

the first portion has a lower end in the up-down direction;

the second portion extends in a width direction perpendicular to the up-down direction from the lower end of the first portion; and the ground contact portion is brought into contact with the second portion.

* * * * *